US012709503B2

(12) United States Patent
Shimosaka et al.

(10) Patent No.: US 12,709,503 B2
(45) Date of Patent: Aug. 18, 2026

(54) MEDIUM CONVEYANCE DEVICE

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/575,714

(22) PCT Filed: Jul. 14, 2021

(86) PCT No.: PCT/JP2021/026494
§ 371 (c)(1),
(2) Date: Dec. 29, 2023

(87) PCT Pub. No.: WO2023/286214
PCT Pub. Date: Jan. 19, 2023

(65) Prior Publication Data
US 2024/0308797 A1 Sep. 19, 2024

(51) Int. Cl.
*B65H 3/06* (2006.01)
*B65H 3/66* (2006.01)

(52) U.S. Cl.
CPC ..... *B65H 3/0661* (2013.01); *B65H 3/66* (2013.01); *B65H 2404/5311* (2013.01); *B65H 2511/40* (2013.01)

(58) Field of Classification Search
CPC B65H 3/0661; B65H 3/66; B65H 2404/5311; B65H 2511/40; B65H 3/063; B65H 3/0684; B65H 3/56
See application file for complete search history.

(56) References Cited

U.S. PATENT DOCUMENTS 10,015,335 B2 * 7/2018 Shuto ..... B65H 7/02
10,625,965 B2 * 4/2020 Kuriki ..... B65H 3/063
(Continued)

FOREIGN PATENT DOCUMENTS

JP 3711069 B2 8/2005
JP 2007-126226 A 5/2007
(Continued)

OTHER PUBLICATIONS

Japanese Office Action dated Jan. 7, 2025 regarding Japanese Patent Application No. 2024-068637 corresponding to U.S. Appl. No. 18/575,714 (3 pages) with English Translation (6 pages).
(Continued)

*Primary Examiner* — Scott A Browne
*Assistant Examiner* — Lidia Kwiatkowska
(74) *Attorney, Agent, or Firm* — WOMBLE BOND DICKINSON US LLP

(57) ABSTRACT

A medium conveying apparatus includes a loading tray, a feed roller, a separation roller, a bottom surface guide located at a first position where contact between a bottom surface of the medium placed on the loading tray and the feed roller is restricted, before medium feeding, a first guide engaged with the bottom surface guide located at the first position to restrict contact between a front edge of the medium placed on the loading tray and the separation roller, before medium feeding, and a second guide located between an upstream edge of the separation roller in a medium conveying direction and a central part of the separation roller to regulate the front edge of the medium at a position apart upwardly by a predetermined distance from a nip part of the feed roller and the separation roller, at a time of medium feeding.

11 Claims, 22 Drawing Sheets

(56) References Cited

U.S. PATENT DOCUMENTS

| | | | | |
|---|---|---|---|---|
| 2003/0063337 | A1 | 4/2003 | Shirai et al. | |
| 2008/0203652 | A1 | 8/2008 | Yasukawa et al. | |
| 2018/0041652 | A1* | 2/2018 | Miyauchi | G03G 15/602 |
| 2019/0144225 | A1* | 5/2019 | Nishizaka | B65H 3/56 271/121 |
| 2019/0185281 | A1* | 6/2019 | Niwata | B65H 1/02 |

FOREIGN PATENT DOCUMENTS

| | | | |
|---|---|---|---|
| JP | 4820314 | B2 | 9/2011 |
| JP | 2017-19606 | A | 1/2017 |
| JP | 2018-24484 | A | 2/2018 |
| JP | 2019-89628 | A | 6/2019 |
| JP | 3225460 | U | 3/2020 |

OTHER PUBLICATIONS

International Search Report of PCT/JP2021/026494, Aug. 17, 2021, 2 pages.

Office Action of JP 2023-534522, Dec. 12, 2023, 9 pages with English Translation.

International Search Report dated Aug. 17, 2021 for corresponding PCT Application No. PCT/JP2021/026494 (3 pages) with English Translation (2 pages).

Written Opinion dated Aug. 17, 2021 for corresponding PCT Application No. PCT/JP2021/026494 (5 pages) with English Translation (5 pages).

International Preliminary Report on Patentability dated Jan. 16, 2024 for corresponding PCT Application No. PCT/JP2021/026494 (6 pages) with English Translation (6 pages).

* cited by examiner

MEDIUM CONVEYANCE DEVICE

CROSS-REFERENCE TO RELATED APPLICATION(S)

This application is a U.S. National Phase Patent Application and claims priority to and the benefit of International Application Number PCT/JP2021/026494, filed on Jul. 14, 2021, the entire content of which is incorporated herein by reference.

TECHNICAL FIELD

The present disclosure relates to a medium conveying apparatus and particularly relates to a medium conveying apparatus including a feed roller and a separation roller.

BACKGROUND ART

In a medium conveying apparatus, such as a scanner, that feeds a plurality of media while separating the media by using a feed roller and a separation roller located to face each other and images the media, preferably a large number of media are placed together in a loading tray and fed in order to achieve enhanced work efficiency of a user. However, as an amount of media placed together in the loading tray increases, the weight of the entire media increases and friction between media increases; and thus a medium in contact with a medium being a feed target may be fed with the target medium and multi feed of media may occur. For example, occurrence of multi feed of media can be suppressed by placing a guide before a nip part of the feed roller and the separation roller to prevent entry of a large number of media into the nip part. However, when a medium with a curled front edge is fed in a case of a guide located before the nip part of the feed roller and the separation roller, entry of the front edge of the medium into the nip part of the feed roller and the separation roller may be hindered by the guide.

A medium feeding apparatus including a plurality of regulation parts at an upstream side of a nip position of a separation roller and a feed roller spaced in a medium width direction, which is a direction intersecting with a feeding direction of a medium, is disclosed (see PTL 1). By coming into contact with the front edge of upper media excluding at least the lowest medium in a media bundle, the regulation part regulates contact of the front edge with the separation roller regardless of deformation of the separation roller.

A sheet conveyance-separation apparatus having a separation roller composed of an elastic body and a conveyance regulation guide relatively protruding by deformation of the elastic body and provided close to the separation roller is disclosed (see PTL 2).

CITATION LIST

Patent Literature

[PTL 1]
Japanese Unexamined Patent Publication (Kokai) No. 2019-89628
[PTL 2]
Japanese Patent No. 3711069

SUMMARY OF INVENTION

A medium conveying apparatus is required to satisfactorily feed a medium.

An object of a medium conveying apparatus is to be able to satisfactorily feed a medium.

According to some embodiments, a medium conveying apparatus includes a loading tray, a feed roller to feed a medium placed on the loading tray, a separation roller located above the feed roller to face the feed roller, a bottom surface guide located at a first position where contact between a bottom surface of the medium placed on the loading tray and the feed roller is restricted, before medium feeding, and located at a second position where contact between the bottom surface of the medium placed on the loading tray and the feed roller is allowed, at a time of medium feeding, a first guide engaged with the bottom surface guide located at the first position, to restrict contact between a front edge of the medium placed on the loading tray and the separation roller, before medium feeding, and a second guide located between an upstream edge of the separation roller and a central part of the separation roller in a medium conveying direction to regulate the front edge of the medium at a position apart upwardly by a predetermined distance from a nip part of the feed roller and the separation roller, at a time of medium feeding.

The medium conveying apparatus according to the present embodiment can satisfactorily feed a medium.

The object and advantages of the invention will be realized and attained by means of the elements and combinations, in particular, described in the claims. It is to be understood that both the foregoing general description and the following detailed description are exemplary and explanatory, and are not restrictive of the invention, as claimed.

DESCRIPTION OF EMBODIMENTS

Hereinafter, a medium conveying apparatus, a control method and a control program according to an embodiment, will be described with reference to the drawings. However, it should be noted that the technical scope of the invention is not limited to these embodiments, and extends to the inventions described in the claims and their equivalents.

Figure 1:
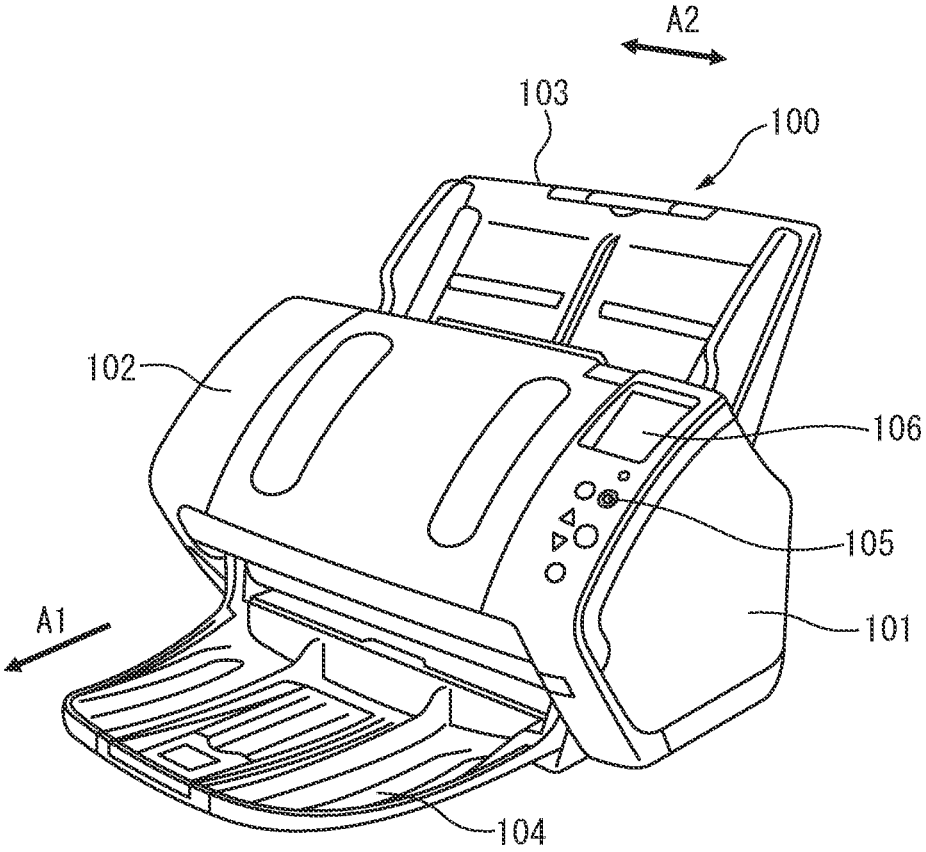
FIG. 1 is a perspective view illustrating a medium conveying apparatus according to an embodiment.

FIG. 1 is a perspective view illustrating a medium conveying apparatus configured as an image scanner. The medium conveying apparatus 100 conveys and images a medium being a document. Examples of a medium include paper, thin paper, thick paper, a card, and a passport. Cards include an ID card based on ID-1 defined by the International Organization for Standardization (ISO)/International Electrotechnical Commission (IEC) 7810. Further, cards include an ID card with embossment defined by the ISO/IEC 7811-1. The medium conveying apparatus 100 may be a facsimile, a copying machine, a multifunctional peripheral (MFP), etc. A conveyed medium may be an object being printed on, etc., instead of a document, and the medium conveying apparatus 100 may be a printer, etc.

The medium conveying apparatus 100 includes a lower housing 101, an upper housing 102, a loading tray 103, an ejection tray 104, an operation device 105, a display device 106, etc.

An arrow A1 in FIG. 1 indicates a medium conveying direction. An upper stream hereinafter refers to an upper stream in the medium conveying direction A1, and a lower stream refers to a lower stream in the medium conveying direction A1. An arrow A2 in FIG. 1 indicates a width direction perpendicular to the medium conveying direction.

The upper housing 102 is located at a position covering the top surface of the medium conveying apparatus 100 and is engaged with the lower housing 101 by a hinge in such a way as to be openable when, for example, a medium is stuck or cleaning of the inside of the medium conveying apparatus 100 is performed.

The loading tray 103 is engaged with the lower housing 101 and places a medium to be fed and conveyed. The loading tray 103 is inclined downward from the upstream side to the downstream side. Consequently, the medium conveying apparatus 100 can satisfactorily convey a medium by using the self-weight of the medium. The ejection tray 104 is engaged with the upper housing 102 and places an ejected medium. The ejection tray 104 may be engaged with the lower housing 101.

The operation device 105 includes an input device such as a button, and an interface circuit acquiring a signal from the input device, accepts an input operation by a user, and outputs an operation signal based on the input operation by the user. The display device 106 includes a display including a liquid crystal, an organic electro-luminescence (EL), etc., and an interface circuit outputting image data to the display, and displays the image data on the display.

Figure 2:
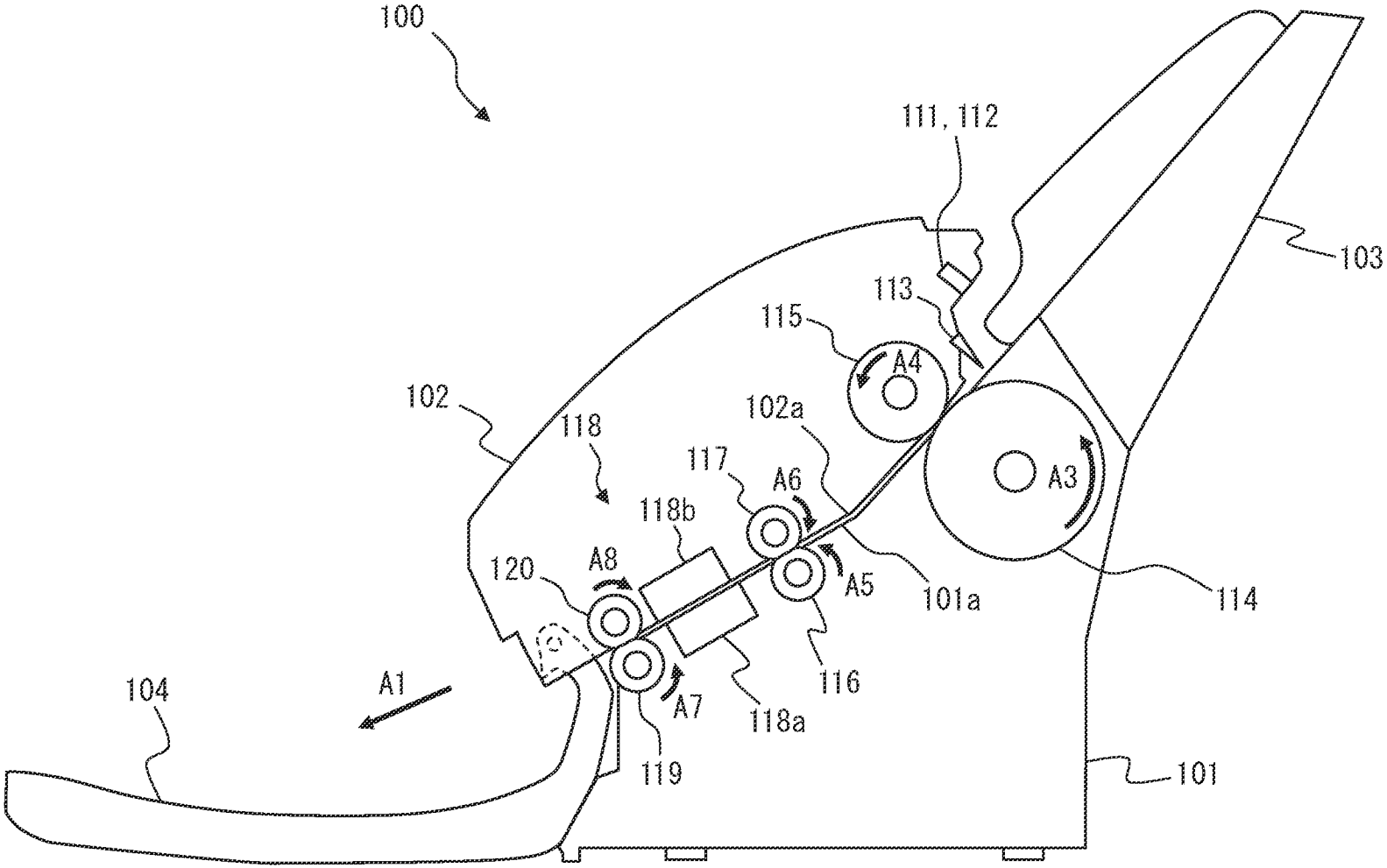
FIG. 2 is a diagram for illustrating a conveyance path inside an example of a medium conveying apparatus.

FIG. 2 is a diagram for illustrating a conveyance path inside a medium conveying apparatus.

The conveyance path inside the medium conveying apparatus 100 includes a loaded amount sensor 111, a medium size sensor 112, a medium sensor 113, a feed roller 114, a separation roller 115, a first conveyance roller 116, a second conveyance roller 117, an imaging device 118, a first ejection roller 119, a second ejection roller 120, etc.

Each of the numbers of the feed roller 114, the separation roller 115, the first conveyance roller 116, the second conveyance roller 117, the first ejection roller 119, and/or the second ejection roller 120 is not limited to one and may be more than one. In that case, a plurality of feed rollers 114, separation rollers 115, first conveyance rollers 116, second conveyance rollers 117, first ejection rollers 119, and/or second ejection rollers 120 are respectively spaced in the width direction A2.

The top surface of the lower housing 101 forms a lower guide 101*a* of the conveyance path of a medium, and the bottom surface of the upper housing 102 forms an upper guide 102*a* of the conveyance path of a medium.

The loaded amount sensor 111 is a sensor for detecting a loaded amount of media placed on the loading tray 103 and is located on the upstream side of the feed roller 114 and the separation roller 115. For example, the loaded amount sensor 111 is an infrared proximity distance sensor measuring the distance to an object existing at a facing position based on the time difference between emission and reflection of infrared rays. The loaded amount sensor 111 includes a light emitter and a light receiver that are provided in the upper housing 102. The light emitter is a light emitting diode (LED), etc., and emits light (infrared rays) toward the loading tray 103. On the other hand, the light receiver is a photodiode, etc., receives light emitted by the light emitter and reflected by the loading tray 103 or a medium placed on the loading tray 103, and generates and outputs a loaded amount signal being an electric signal based on the received light. For example, the loaded amount signal indicates the time elapsed after the light emitter emits light until the light receiver receives the light. The medium conveying apparatus 100 detects the height of media placed on the loading tray 103 as a loaded amount of media, based on the loaded amount signal.

The loaded amount sensor 111 may be a moving amount sensor (actuator). The moving amount sensor includes a contact member coming into contact with the top surface of a medium placed highest of media placed on the loading tray 103 and being provided to be movable upwardly by the medium coming into contact and detects a moving amount of the contact member. The loaded amount sensor 111 generates and outputs a loaded amount signal being an electric signal based on the detected moving amount. The medium conveying apparatus 100 detects the height of media placed on the loading tray 103 as a loaded amount of media, based on the loaded amount signal.

The loaded amount sensor 111 may be a weight sensor for detecting the weight of media placed on the loading tray 103. The weight sensor includes a pressure sensitive sheet (conductive coated sheet) located between the lower housing 101 and the loading tray 103, and the loaded amount sensor 111 generates and outputs a loaded amount signal being an electric signal based on the magnitude of pressure sensed by the pressure sensitive sheet. As the weight of media placed on the loading tray 103 increases, the pressing force exerted on the lower housing 101 by the loading tray 103 increases, and the pressure sensed by the pressure sensitive sheet increases. The medium conveying apparatus 100 detects the weight of media placed on the loading tray 103 as a loaded amount of media, based on the loaded amount signal.

The medium size sensor 112 is a sensor for detecting the size of a medium and is located on the upstream side of the feed roller 114 and the separation roller 115. For example, the medium size sensor 112 includes a plurality of optical sensors spaced in the width direction A2, each optical sensor detecting a medium at each position where the optical sensor is located. Each optical sensor includes a light emitter and a light receiver that are provided in one of the lower housing 101 and the upper housing 102, and a light guide provided in the other of the lower housing 101 and the upper housing 102 at a position facing the light emitter and the light receiver. The light emitter is an LED, etc., and emits light toward the light guide. On the other hand, the light receiver is a photodiode, etc., and receives light emitted by the light emitter and guided by the light guide. When a medium exists at a position facing each light emitter and each light receiver, light emitted by the light emitter is blocked by the medium; and therefore the light receiver does not detect the light emitted by the light emitter. The medium size sensor 112 generates and outputs a medium size signal indicating whether a medium exists at a position facing each light emitter and each light receiver, based on the intensity of light received by the light receiver.

A reflection member such as a mirror may be used in place of the light guide. The light emitter and the light receiver may be provided to face each other with the medium conveyance path in between.

The medium size sensor 112 may be infrared proximity distance sensors spaced in the width direction A2, each sensor measuring the distance to an object existing at a facing position from the time difference between emission and reflection of infrared rays at a position where the sensor is located. In that case, the medium size sensor 112 includes a light emitter and a light receiver that are provided in the upper housing 102. The light emitter is an LED, etc., and emits light (infrared rays) toward the loading tray 103. On the other hand, the light receiver is a photodiode, etc., and receives light emitted by the light emitter and reflected by the loading tray 103 or a medium placed on the loading tray 103. When a medium exists at a position facing each light emitter and each light receiver, light emitted from the light emitter is reflected by the medium, and therefore the time elapsed after the light emitter emits light until the light receiver receives the light is shorter than the time when a medium does not exist at the position facing the light emitter and the light receiver. The medium size sensor 112 generates and outputs a medium size signal indicating whether a medium exists at a position facing each light emitter and each light receiver, based on the time elapsed after the light emitter emits light until the light receiver receives light.

The medium size sensor 112 may be contact detection sensors being spaced in the width direction A2 and passing predetermined current when a medium is in contact at a position where each sensor is located or when a medium is not in contact. The medium size sensor 112 generates and outputs a medium size signal indicating whether a medium exists at a position facing each contact detection sensor, depending on whether a medium is in contact with the contact detection sensor.

The medium size sensor 112 may include an image sensor including two-dimensionally arranged complementary metal oxide semiconductor-(CMOS-) based or charge coupled device-(CCD-) based imaging elements. The medium size sensor 112 is located in such a way as to be able to image an entire medium placed on the loading tray 103. In that case, the medium size sensor 112 further includes lenses each forming an image on an imaging element, and an A/D converter amplifying and analog-digital (A/D) converting an electric signal output from the imaging element. The medium size sensor 112 generates an image signal by imaging a medium placed on the loading tray 103 and outputs the signal as a medium size signal.

The medium sensor 113 is located on the upstream side of the feed roller 114 and the separation roller 115. The medium sensor 113 includes a contact detection sensor and detects whether a medium is placed on the loading tray 103. The medium sensor 113 generates and outputs a medium signal the signal value of which varies between a state in which a medium is placed on the loading tray 103 and a state in which a medium is not placed. The medium sensor 113 is not limited to a contact detection sensor and any other sensor that can detect existence of a medium, such as a light detection sensor, may be used as the medium sensor 113.

The feed roller 114 is provided in the lower housing 101, sequentially separates media placed on the loading tray 103 from the lower side, and feeds the media. The separation roller 115 is a so-called brake roller or retard roller, is located in the upper housing 102, i.e., above the feed roller 114 to face the feed roller 114, and rotates in a direction opposite to the medium feeding direction.

The first conveyance roller 116 and the second conveyance roller 117 are located on the downstream side of the feed roller 114 in such a way as to face each other and convey a medium fed by the feed roller 114 and the separation roller 115 to the imaging device 118. The first conveyance roller 116 is provided in the lower housing 101, and the second conveyance roller 117 is provided in the upper housing 102 and above the first conveyance roller 116.

The imaging device 118 is located on the downstream side of the first conveyance roller 116 and the second conveyance roller 117 and images a medium conveyed by the first conveyance roller 116 and the second conveyance roller 117. The imaging device 118 includes a first imaging device **118*a* and a second imaging device 118*b* that are located to face each other with the medium conveyance path in between. The first imaging device 118*a* includes a line sensor based on a unity-magnification optical system type contact image sensor (CIS) including CMOS-based imaging elements linearly arranged in a main scanning direction. The first imaging device 118*a* further includes lenses each forming an image on an imaging element, and an A/D converter amplifying and analog-digital (A/D) converting an electric signal output from the imaging element. The first imaging device 118*a*** generates an input image by imaging the front side of a conveyed medium in accordance with control from a processing circuit to be described later and outputs the generated image.

Similarly, the second imaging device **118*b* includes a line sensor based on a unity-magnification optical system type CIS including CMOS-based imaging elements linearly arranged in the main scanning direction. The second imaging device 118*b* further includes lenses each forming an image on an imaging element, and an A/D converter amplifying and analog-digital (A/D) converting an electric signal output from the imaging element. The second imaging device 118*b*** generates an input image by imaging the back side of a conveyed medium in accordance with control from the processing circuit to be described later and outputs the generated image.

Only one of the first imaging device 118*a* and the second imaging device 118*b* may be located and only one side of a medium may be read in the medium conveying apparatus 100. Further, a line sensor based on a unity-magnification optical system type CIS including CCD-based imaging elements may be used in place of the line sensor based on a unity-magnification optical system type CIS including CMOS-based imaging elements. Further, a reduction optical system type line sensor including CMOS-based or CCD-based imaging elements may be used.

The first ejection roller 119 and the second ejection roller 120 are located on the downstream side of the imaging device 118 in such a way as to face each other and eject a medium conveyed by the first conveyance roller 116 and the second conveyance roller 117 and imaged by the imaging device 118 into the ejection tray 104. The first ejection roller 119 is provided in the lower housing 101, and the second ejection roller 120 is provided in the upper housing 102 and above the first ejection roller 119.

A medium placed on the loading tray 103 is conveyed between the lower guide 101*a* and the upper guide 102*a* toward the medium conveying direction A1 by the feed roller 114 rotating in a direction of an arrow A3 in FIG. 2, i.e., the medium feeding direction. As a feed mode, the medium conveying apparatus 100 has a separation mode for separating and feeding a medium and a non-separation mode for feeding a medium without separation. The feed mode is set by a user by using the operation device 105 or an information processing apparatus communicatively coupled to the medium conveying apparatus 100. When the feed mode is set to the separation mode, the separation roller 115 rotates in a direction of an arrow A4, i.e., a direction opposite to the medium feeding direction at the time of medium feeding. When a plurality of media are placed on the loading tray 103, only a medium in contact with the feed roller 114 of the medium placed on the loading tray 103 is separated by working of the feed roller 114 and the separation roller 115. Consequently, conveyance of a medium other than the separated medium is restricted (prevention of multi feed). On the other hand, when the feed mode is set to the non-separation mode, the separation roller 115 rotates in a direction opposite to the arrow A4, i.e., the medium feeding direction.

A medium is fed between the first conveyance roller 116 and the second conveyance roller 117 while being guided by the lower guide 101*a* and the upper guide 102*a*. The medium is fed between the first imaging device 118*a* and the second imaging device 118*b* by the first conveyance roller 116 and the second conveyance roller 117 rotating in directions of an arrow A5 and an arrow A6, respectively. The medium read by the imaging device 118 is ejected into the ejection tray 104 by the first ejection roller 119 and the second ejection roller 120 rotating in directions of an arrow A7 and an arrow A8, respectively.

Figure 3:
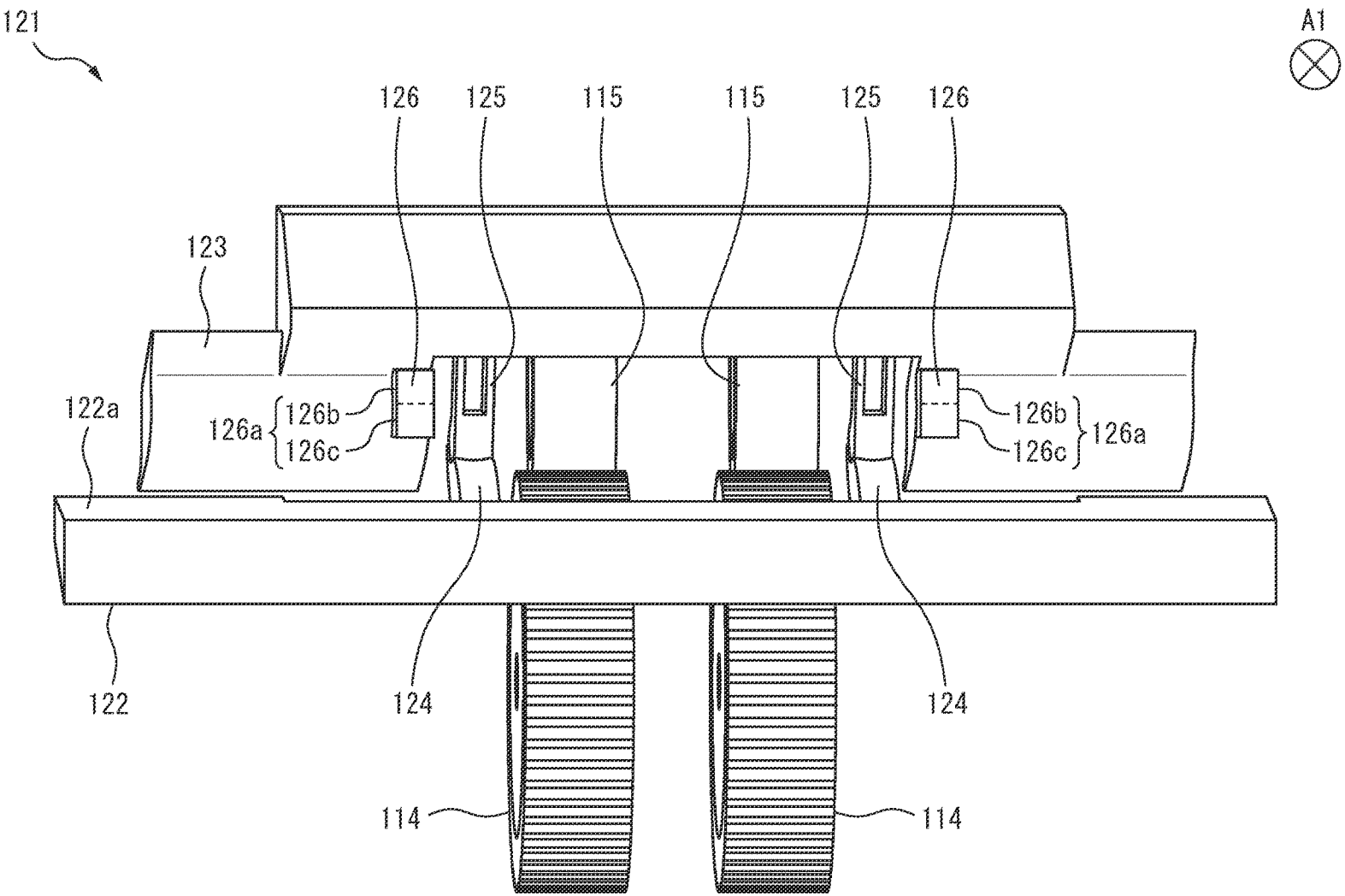
FIG. 3 is a schematic diagram for illustrating an example of a feeding mechanism.
Figure 4:
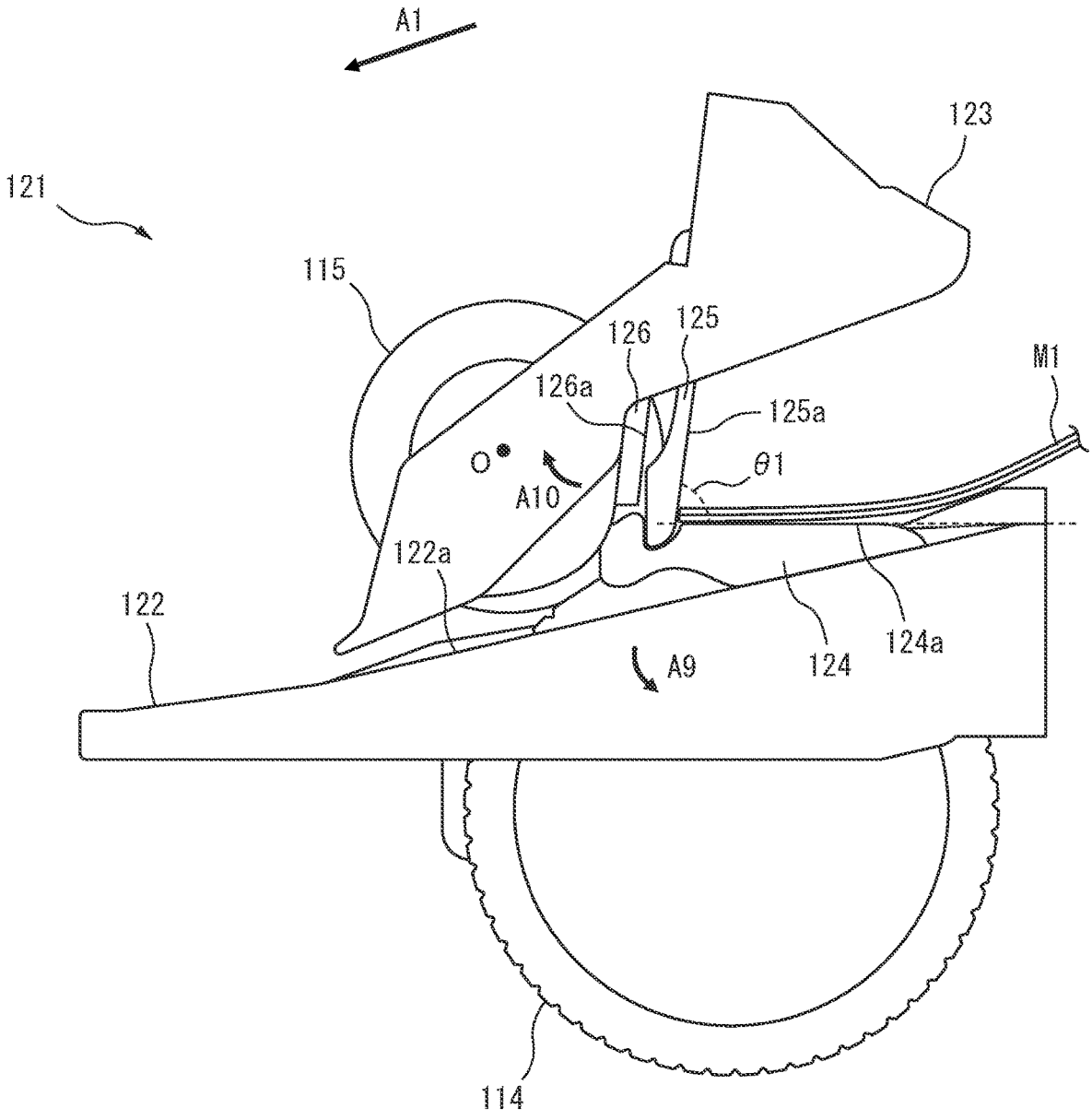
FIG. 4 is a schematic diagram for illustrating an example of a feeding mechanism.

FIG. 3 and FIG. 4 are schematic diagrams for illustrating a feeding mechanism in a medium conveying apparatus. FIG. 3 is a schematic diagram of a feeding mechanism viewed from the upstream side, and FIG. 4 is a schematic diagram of a feeding mechanism viewed from the side (from the width direction A2).

As illustrated in FIG. 3 and FIG. 4, the medium conveying apparatus 100 includes a guide member 122, a separation roller cover 123, a bottom surface guide 124, a first guide 125, a second guide 126, etc., in addition to the feed roller 114 and the separation roller 115, as the feeding mechanism 121. In the example illustrated in FIG. 3, the medium conveying apparatus 100 includes two each of the feed rollers 114 and the separation rollers 115.

The guide member 122 is a plate-shaped member, is provided on the top surface of the lower housing 101 in such a way as to form a conveyance surface 122*a* of a medium and forms part of the lower guide 101*a*. The guide member 122 has an opening in the central part in the width direction A2 perpendicular to the medium conveying direction, and the feed roller 114 is located in the opening.

The separation roller cover 123 is an example of a support part and covers and supports the separation roller 115. The separation roller cover 123 is mounted on the upper housing 102 through an elastic member such as a spring or a rubber and is urged downward by the elastic member. Consequently, the separation roller cover 123 provides urging force to the separation roller 115 in such a way that the separation roller 115 presses the feed roller 114.

The bottom surface guide 124 is a setting guide for setting a medium. The bottom surface guide 124 is located at a position overlapping the feed roller 114 and the separation roller 115 viewed from the width direction A2, i.e., a position overlapping the feed roller 114 and the separation roller 115 in the medium conveying direction A1. The bottom surface guide 124 is provided in the lower housing 101 in such a way as to be able to swing (rotate) downward (in a direction of an arrow A9 in FIG. 4) according to driving force from a motor. The bottom surface guide 124 is located at a first position (a placement position illustrated in FIG. 4) where contact between the bottom surface of a medium M1 placed on the loading tray 103 and the feed roller 114 is restricted before medium feeding and supports the bottom surface of the medium M1 placed on the loading tray 103 at a support surface 124*a*.

The bottom surface guide 124 is formed of a high-slidability (exerting weak frictional force on a medium) member such as a plastic member. In particular, the bottom surface guide 124 is formed of a member the frictional force of which with PPC paper is weaker than the frictional force between two sheets of two PPC paper.

In order to allow the feed roller 114 to satisfactorily feed a medium, the outer peripheral surface of the feed roller 114 is formed of a rubber member, etc., the frictional force of which on a medium is strong. Therefore, the frictional force between a medium placed lowest of a plurality of media M1 placed on the loading tray 103 and the feed roller 114 is stronger than the frictional force between the media M1. Further, in order to allow a medium to be easily conveyed by the self-weight, the downstream side of the loading tray 103 is inclined downward in the medium conveying apparatus 100. Accordingly, assuming that the medium conveying apparatus does not include a bottom surface guide, the front edge of a medium placed above a medium placed lowest precedes the front edge of the lowest medium (moves to the downstream side) before medium feeding, and thus multi feed of media is more likely to occur at the time of medium feeding.

On the other hand, the medium placed lowest out of media M1 placed on the loading tray 103 slides on the bottom surface guide 124 and makes an entry into a position in contact with the first guide 125 before medium feeding in the medium conveying apparatus 100. Accordingly, the medium conveying apparatus 100 can suppress occurrence of multi feed of media.

The first guide 125 is a flap and is a stopper for preventing a medium from entering a nip part of the feed roller 114 and the separation roller 115 before medium feeding. The first guide 125 is located at a position facing the bottom surface guide 124 in the medium conveying direction A1. The first guide 125 is provided on a feed arm, which is described later, stored in the separation roller cover 123 to be able to swing (rotate) to the downstream side (a direction of an arrow A10 in FIG. 4) and is pressed toward the upstream side (a direction opposite to the arrow A10) by an elastic member such as a helical torsion coil spring. The first guide 125 is engaged with the bottom surface guide 124 located at the first position before medium feeding and restricts contact of the front edge of a medium M1 placed on the loading tray 103 with the separation roller 115. In other words, the first guide 125 prevents entry of the medium into the nip part of the feed roller 114 and the separation roller 115 before medium feeding. The first guide 125 is provided to work with the feed arm; and when the first guide 125 is engaged with the bottom surface guide 124, the feed arm is supported by the first guide 125 and the bottom surface guide 124, and downward movement of the feed arm is prevented. Therefore, the feed arm is stored in the separation roller cover 123 in FIG. 3 and FIG. 4.

As illustrated in FIG. 4, the first guide 125 is located on the upstream side of the upstream edge of the separation roller 115 in the medium conveying direction A1 and close to the separation roller 115 before medium feeding. Therefore, the difference between the position (height) of a medium being stopped by contacting with the first guide 125 before medium feeding and the position (height) of the medium being stopped by contacting with the separation roller 115 immediately after medium feeding starts is small, and the magnitude of potential energy generated by the height difference is small. Accordingly, reduction in medium separation force due to the medium coming into contact with the separation roller 115 with force immediately after the medium feeding starts and the separation roller 115 being pushed up by the medium is suppressed. Accordingly, the medium conveying apparatus 100 can suppress occurrence of multi feed of media and satisfactorily separate a plurality of media.

The first guide 125 is engaged with the bottom surface guide 124 located at the first position in such a way as to be tilted relative to the bottom surface guide 124. In other words, an angle θ1 formed by a contact surface 125*a* of the first guide 125 coming into contact with the front edge of the medium M1 and the support surface 124*a* of the bottom surface guide 124 is set to be greater than 0° and less than 90°. The angle θ1 is particularly set to be greater than 45° and less than 90°. Consequently, when a plurality of media are loaded in the loading tray 103, the front edge of a lower medium is placed more on the downstream side before medium feeding, and therefore a medium placed lowest is more likely to enter the nip part of the feed roller 114 and the separation roller 115 when medium feeding starts. Accordingly, the medium conveying apparatus 100 can smoothly feed a medium when medium feeding starts and can reduce the time required for medium feeding.

In the examples illustrated in FIG. 3 and FIG. 4, a plurality of sets of the first guide 125 and the bottom surface guide 124 are spaced in the width direction A2 perpendicular to the medium conveying direction, and the first guides 125 are located at substantially identical positions in the medium conveying direction A1. Further, the sets of the first guide 125 and the bottom surface guide 124 are spaced at intervals of the width of a minimum medium size supported by the medium conveying apparatus 100 (such as the length of the A8 size in a widthwise direction) or less in the width direction A2. Consequently, even when a medium with the width of the minimum medium size supported by the medium conveying apparatus 100 is fed, the front edge of the medium is positioned at least two points by the first guides 125 before medium feeding, and therefore placement of the front edge of the medium in a tilted manner is suppressed. Accordingly, the medium conveying apparatus 100 can suppress that the part of the front edge of the medium coming into contact with the separation roller 115 before medium feeding and can suppress occurrence of skew of the medium. The sets of the first guide 125 and the bottom surface guide 124 may be spaced in the width direction A2 at intervals greater than the width of the minimum medium size supported by the medium conveying apparatus 100.

The second guide 126 includes a contact surface 126*a* coming into contact with the front edge of a fed medium. The second guide 126 is provided on the separation roller cover 123 and above the nip part of the feed roller 114 and the separation roller 115 in such a way as to protrude from the separation roller cover 123. As illustrated in FIG. 4, the second guide 126 is located between the upstream edge of the separation roller 115 in the medium conveying direction A1 and a central part O of the separation roller 115 in the medium conveying direction A1.

As illustrated in FIG. 3, the second guide 126 is located outer side than the first guide 125 in the width direction A2 perpendicular to the medium conveying direction and close to the separation roller 115. For example, the inside edge of the second guide 126 is located within 30 mm from the outside edge of the separation roller 115 in the width direction A2. Consequently, the second guide 126 can regulate the central part of a medium in the width direction A2 and can suitably stop the medium. In particular, the second guide 126 can satisfactorily regulate the front edge of a medium when a plurality of small-sized media are placed together in the loading tray 103 and are fed. The first guide 125 and/or the second guide 126 may be located between the two separation rollers 115 in the width direction A2.

The second guide 126 is formed in such a way that the friction coefficient of a first region 126*b* above a predetermined position is greater than the friction coefficient of a second region 126*c* below the predetermined position at the contact surface 126*a*. In other words, the second guide 126 is formed in such a way that the surface roughness or the frictional resistance of the member varies between the first region 126*b* and the second region 126*c*. For example, the predetermined position is set to the center position between the top position and the bottom position of the contact surface 126*a*. The predetermined position may be set to any position on the contact surface 126*a*. For example, the friction coefficient of the first region 126*b* is set to 0.5 or greater. For example, an uneven shape is formed in the first region 126*b*. Alternatively, a rubber member may be affixed to the first region 126*b*. On the other hand, for example, the friction coefficient of the second region 126*c* is set to 0.5 or less (such as about 0.3). For example, the second region 126*c* is formed of a resin material. Consequently, the second guide 126 causes the front edge of a medium to be easily hooked in the upper side region of the contact surface 126*a* and thus suitably hinders entry of the medium into the downstream side. On the other hand, the second guide 126 causes the front edge of the medium to smoothly fall in the lower side region of the contact surface 126*a* and causes a press roller to be described later to satisfactorily guide the medium to the nip part of the feed roller 114 and the separation roller 115.

In the example illustrated in FIG. 3 and FIG. 4, a plurality of the second guides 126 are spaced in the width direction A2 perpendicular to the medium conveying direction, and the second guides 126 are located at substantially identical positions in the medium conveying direction A1. Further, the second guides 126 are spaced in the width direction A2 at intervals of a length acquired by adding a margin (such as 40 mm) to the width of the minimum medium size supported by the medium conveying apparatus 100 or less. Consequently, when a medium mainly fed in the medium conveying apparatus 100 (such as a medium larger than or equal to the A6 size) is fed, the front edge of the medium is positioned at least two points by the second guides 126 before medium feeding. Therefore, the medium conveying apparatus 100 can suppress placement of the front edge of the medium in a tilted manner and can suppress occurrence of skew of the medium.

Figure 5:
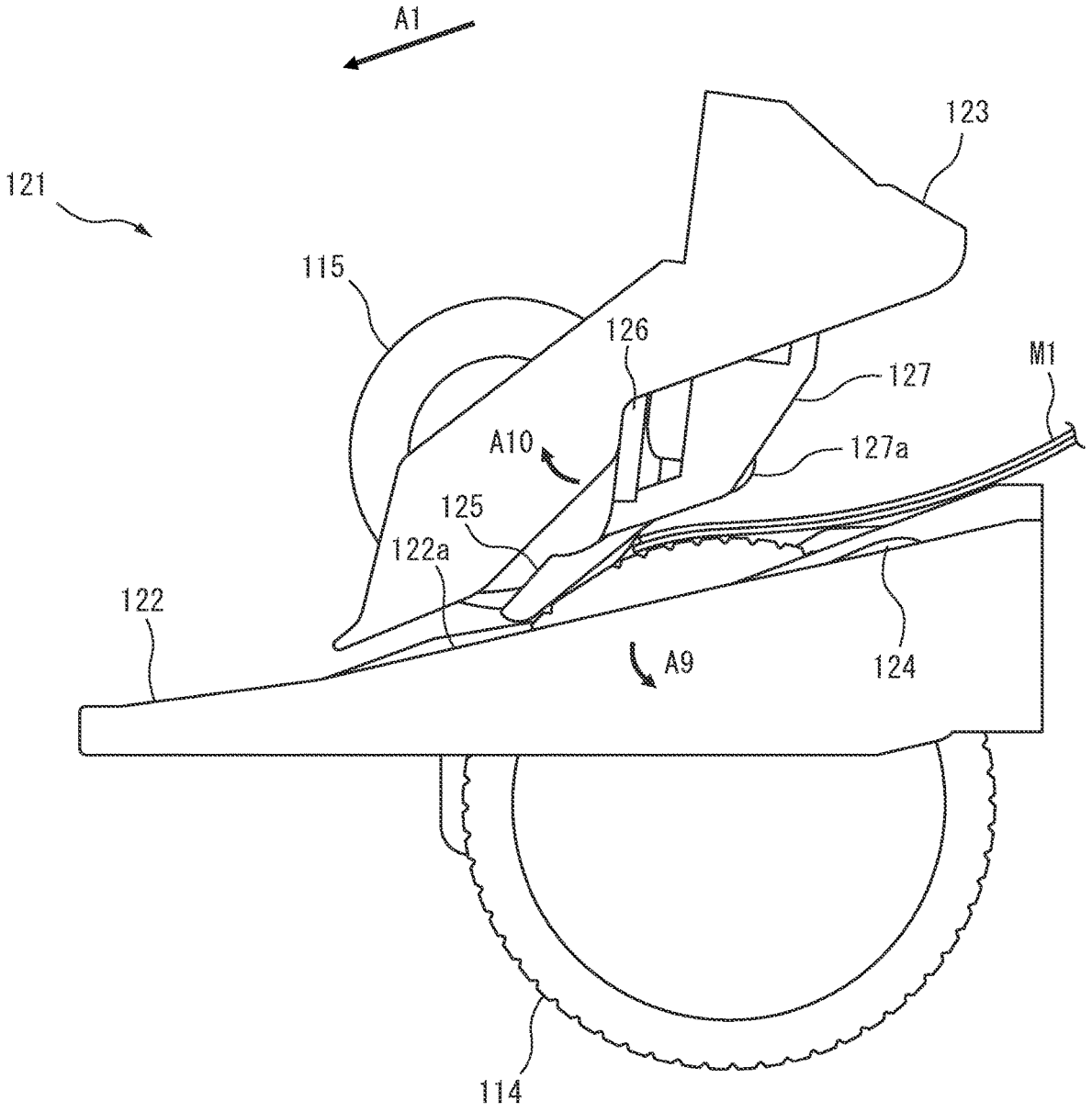
FIG. 5 is a schematic diagram for illustrating an example of a first guide, etc.

FIG. 5 is a schematic diagram for illustrating a bottom surface guide and a first guide during medium feeding. FIG. 5 is a schematic diagram of a feeding mechanism during medium feeding viewed from the side.

As illustrated in FIG. 5, the feeding mechanism 121 further includes a feed arm 127. As described above, the feed arm 127 is stored in the separation roller cover 123 to be movable in the vertical direction relative to the separation roller cover 123. The feed arm 127 is mounted in the separation roller cover 123 through an elastic member such as a spring or a rubber and is urged downward relative to the separation roller cover 123 by the elastic member.

A press roller 127*a* is provided on the feed arm 127. The press roller 127*a* faces the feed roller 114 and is located on the upstream side of the nip part of the feed roller 114 and the separation roller 115 in the medium conveying direction A1. The press roller 127*a* presses a medium fed by the feed roller 114 to the feed roller 114 side from above. The press roller 127*a* and the feed roller 114 sandwich the medium in between, and the press roller 127*a* provides conveyance force to the medium fed by the feed roller 114. Consequently, the medium conveying apparatus 100 can satisfactorily feed the medium.

When medium feeding starts, the bottom surface guide 124 swings below the conveyance surface 122*a* of the guide member 122 (in the direction of the arrow A9). Consequently, the bottom surface guide 124 is located at a second position (a placement position illustrated in FIG. 5) where contact between the bottom surface of a medium M1 placed on the loading tray 103 and the feed roller 114 is allowed at the time of medium feeding and separates from the bottom surface of the medium M1 placed on the loading tray 103.

By the bottom surface guide 124 being located at the second position, the engagement between the first guide 125 and the bottom surface guide 124 is released. Consequently, the first guide 125 is pushed by the front edge of the medium M1 placed on the loading tray 103 and swings to the downstream side (the direction of the arrow A10), and the medium M1 becomes able to enter the nip part of the feed roller 114 and the separation roller 115. Thus, the first guide 125 allows entry of the medium M1 into the nip part of the feed roller 114 and the separation roller 115 when the bottom surface guide 124 is located at the second position.

As described above, since the feed arm 127 is urged downward by the elastic member, the feed arm 127 moves downward (to the feed roller 114 side) by release of the engagement between the first guide 125 and the bottom surface guide 124. In the example illustrated in FIG. 4 and FIG. 5, an amount of media M1 placed on the loading tray 103 is sufficiently small. In this case, first, the feed roller 114 comes into contact with a medium placed lowest of the media M1 placed on the loading tray 103, and the press roller 127*a* subsequently comes into contact with a medium placed uppermost of the media M1 placed on the loading tray 103. In other words, the press roller 127*a* is provided in such a way as to come into contact with a medium placed on the loading tray 103 after the feed roller 114 when an amount of media placed on the loading tray 103 is less than a predetermined amount when the bottom surface guide 124 moves from the first position to the second position.

In a case of an amount of media placed on the loading tray 103 is small, when rotation of the feed roller 114 is started in a state of the press roller 127*a* pressing a medium, the front edge of the medium is likely to be bent upward and thus a jam of the medium is likely to occur. By causing the feed roller 114 to come into contact with a medium before the press roller 127*a* and start feeding of the medium when an amount of media is less than the predetermined amount, the medium conveying apparatus 100 can suppress occurrence of a jam of the medium due to upward bending of the front edge of the medium.

Figure 6:
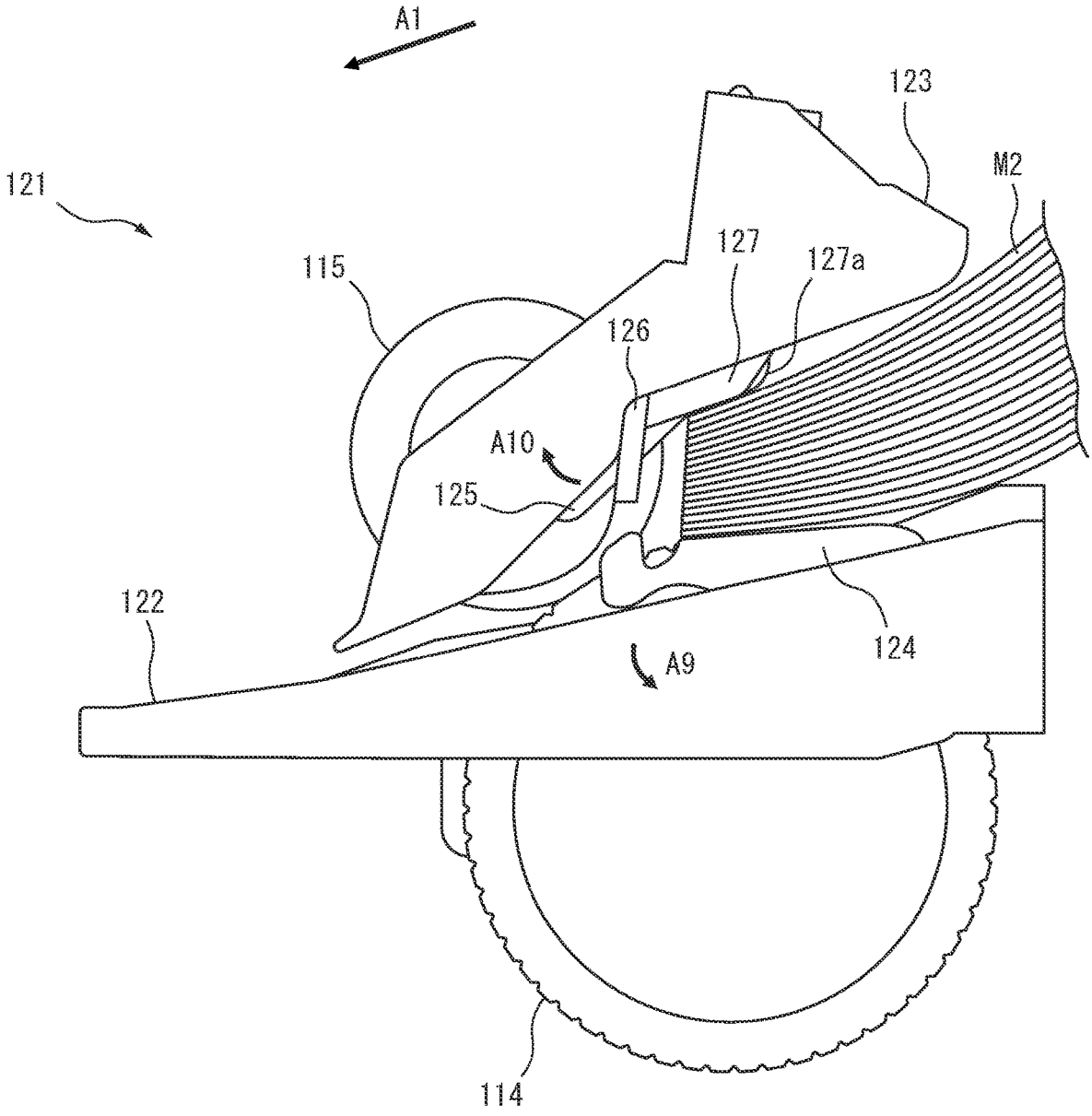
FIG. 6 is a schematic diagram for illustrating an example of a first guide, etc.

FIG. 6 is a schematic diagram for illustrating a bottom surface guide and a first guide when a large amount of media are placed on the loading tray 103. FIG. 6 is a schematic diagram of a feeding mechanism viewed from the side immediately after medium feeding starts when a large amount of the media are placed on a loading tray.

As described above, when medium feeding starts, the engagement between the first guide 125 and the bottom surface guide 124 is released by the bottom surface guide 124 being located at the second position, and the feed arm 127 moves downward. As illustrated in FIG. 6, when a large amount of the media M2 are placed on the loading tray 103, the feed arm 127 lowers before the bottom surface guide 124 fully lowers. Therefore, the press roller 127*a* comes into contact with a medium placed uppermost out of the media M2 placed on the loading tray 103 before the feed roller 114 comes into contact with a medium placed lowest out of the medium M2 placed on the loading tray 103. In other words, the press roller 127*a* is provided in such a way as to come into contact with a medium placed on the loading tray 103 before the feed roller 114 when an amount of media placed on the loading tray 103 is greater than or equal to a predetermined amount when the bottom surface guide 124 moves from the first position to the second position.

When an amount of media placed on the loading tray 103 is large, the feed roller 114 can satisfactorily send out a medium by starting rotation of the feed roller 114 in a state of the press roller 127*a* pressing the medium. In particular, when an amount of media placed on the loading tray 103 is large, stronger urging force is provided to a medium by the elastic member compared with a case of an amount of media being small. For example, when the elastic member is a compression spring, the magnitude of the urging force is a multiplied value acquired by multiplying a contracted amount of the spring by a spring constant. When an amount of media placed on the loading tray 103 is large, the contracted amount of the spring is large and strong urging force is provided to a medium by the press roller 127*a*, and therefore the feed roller 114 can satisfactorily feed the medium.

When an amount of media placed on the loading tray 103 is large, the front edge of a feed target medium existing at the lowest position is pressed down by the weight of media placed thereon, and therefore the possibility of the front edge of the target medium being bent upward is low. Accordingly, when an amount of media placed on the loading tray 103 is large and the possibility of occurrence of a jam of a medium is low, the medium conveying apparatus 100 can satisfactorily feed a medium while giving priority to feedability of a medium.

Figure 7:
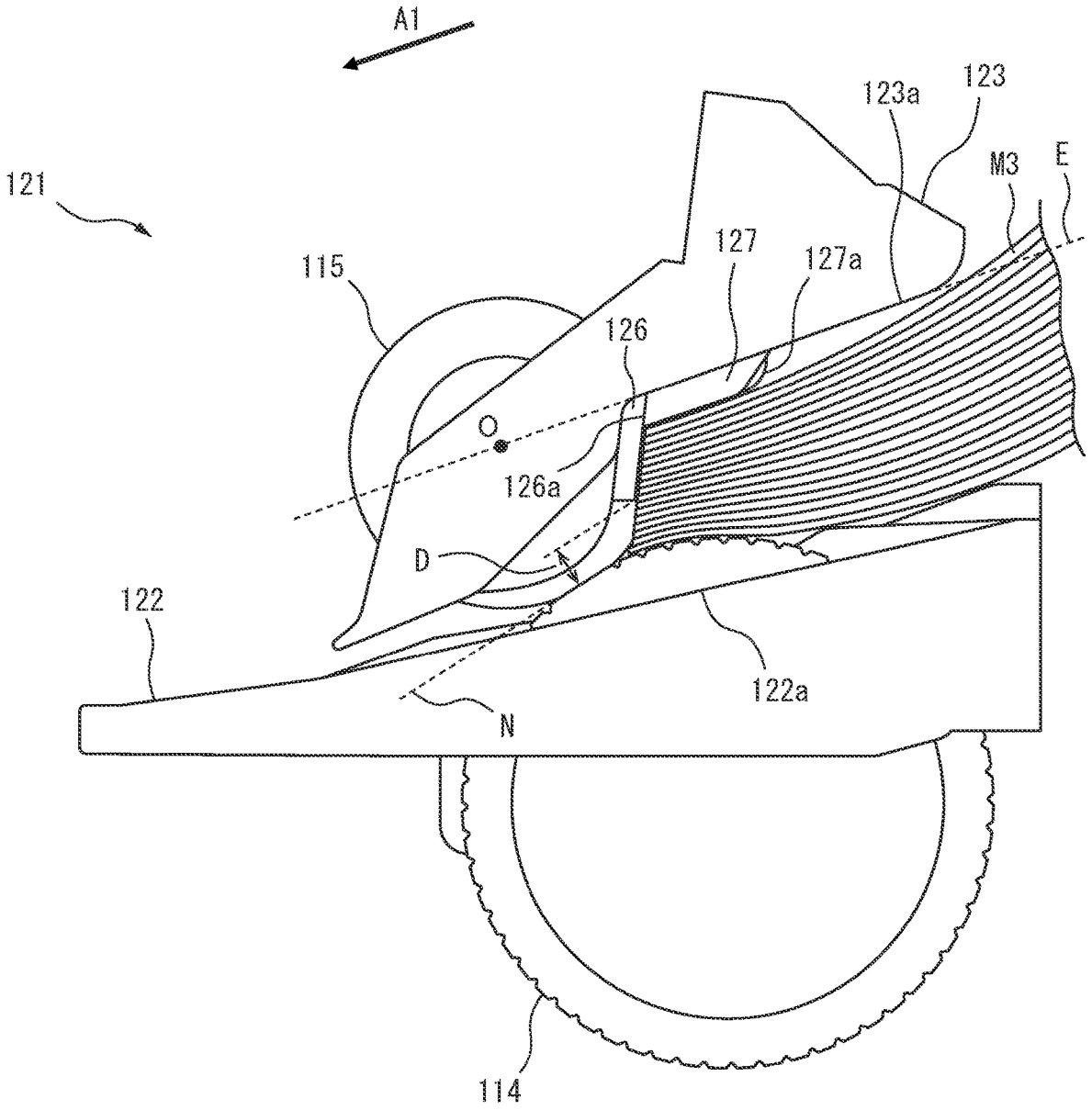
FIG. 7 is a schematic diagram for illustrating an example of a second guide.

FIG. 7 is a schematic diagram for illustrating a second guide when a large amount of media are placed on a loading tray. FIG. 7 is a schematic diagram of a feeding mechanism during medium feeding viewed from the side when a large amount of the media are placed on a loading tray.

As illustrated in FIG. 7, when a large amount of the media M3 are placed on the loading tray 103 and the upstream edge of the separation roller 115 is deformed by being pressed to the downstream side by the media M3, the second guide 126 comes into contact with the front edge of the media M3 and prevents entry of the media M3 into the downstream side. Consequently, the second guide 126 can suppress reduction in medium separation force due to a rise (lift) of the separation roller 115 caused by the media M3.

In particular, when feeding media, the second guide 126 regulates the front edge of a medium at a position apart upwardly by a predetermined distance D from a nip surface N being an extension surface of the nip part of the feed roller 114 and the separation roller 115. In other words, the second guide 126 is located in such a way as not to overlap the feed roller 114 viewed from the width direction A2 perpendicular to the medium conveying direction. Consequently, the second guide 126 comes into contact only with the media placed on the upper side of the media M3 placed on the loading tray 103. Accordingly, the second guide 126 restricts entry of the media placed on the upper side into the downstream side while allowing entry of the media placed on the lower side into the nip part of the feed roller 114 and the separation roller 115. Since the separation roller 115 comes into contact only with the media placed on the lower side, the second guide 126 can suppress reduction in medium separation force due to a rise (lift) of the separation roller 115.

For example, the predetermined distance D is set based on a conveyable number of ID cards supported by the medium conveying apparatus 100. For example, when the conveyable number is three, the predetermined distance D is set to, for example, a length three times or more than the thickness of an ID-1-based ID card defined by the ISO/IEC 7810 (0.76 mm×3=2.28 mm). Consequently, when the conveyable number of ID cards are fed, the second guide 126 can pass each ID card and allow the ID card to enter the nip part of the feed roller 114 and the separation roller 115. The predetermined distance D may be set to, for example, a length three times or more than the thickness of an ID card with embossment defined by the ISO/IEC 7811-1 [(0.76 mm+0.48 mm)×3=3.72 mm]. Consequently, when the conveyable number of ID cards with embossment are fed, the second guide 126 can pass each ID card and allow the ID card to enter the nip part of the feed roller 114 and the separation roller 115.

An ID card has higher stiffness compared with paper, etc., and does not deform. Therefore, when the medium conveying apparatus 100 attempts to separate a plurality of ID cards at the position of the second guide 126, a conveyance load on the feed roller 114 increases. Accordingly, in order to separate a plurality of ID cards at the position of the second guide 126, the medium conveying apparatus 100 needs to increase the force of the separation roller 115 pressing the feed roller 114. However, when the force of the separation roller 115 pressing the feed roller 114 is excessively increased, it becomes difficult for the medium conveying apparatus 100 to separate a medium such as paper. By the second guide 126 being provided to be able to pass a plurality of ID cards, each ID card is suitably separated at the nip part of the feed roller 114 and the separation roller 115, and therefore the medium conveying apparatus 100 can feed both an ID card and paper while performing satisfactory separation.

The size of an ID card is small, and when an ID card is fed, it is highly likely that a side guide is not set. Furthermore, the frictional force between ID cards is weak, and therefore when a plurality of ID cards are to be separated at the position of the second guide 126, an ID card remaining at the position of the second guide 126 is tilted and skew of the medium is highly likely to occur. By the second guide 126 being provided to be able to pass a plurality of ID cards, each ID card is suitably separated at the nip part of the feed roller 114 and the separation roller 115, and therefore the medium conveying apparatus 100 can suppress occurrence of skew of a medium.

On the other hand, when the predetermined distance D is too long, a large amount of media come into contact with the separation roller 115, the separation roller 115 rises and medium separation force is reduced. As a result of performing an experiment of feeding a plurality of types of media with various thicknesses, such as high-quality paper, coated paper, and art paper, while varying the predetermined distance D, a frequency of occurrence of multi feed of media due to a lift of the separation roller 115 sharply increased when the predetermined distance D was greater than 7 mm. Accordingly, the predetermined distance D is preferably set to a length less than or equal to 7 mm.

As illustrated in FIG. 7, the separation roller cover 123 includes a guide surface 123*a* formed on the upstream side of the upstream edge of the separation roller 115 in the medium conveying direction A1. An extension surface E acquired by extending the guide surface 123*a* passes through the central part O of the separation roller 115. In other words, the guide surface 123*a* is formed at a position identical to the central part O of the separation roller 115 in the height direction. When a large amount of media are placed on the loading tray 103 and the media placed on the upper side comes into contact with an upper side position of an outer peripheral surface of the separation roller 115, the separation roller 115 is pressed down from above by the media in contact. As the height of a position with which media come into contact with the outer peripheral surface increases, the force of the media pressing down the separation roller 115 increases. As the force of the media pressing down the separation roller 115 increases, a load for lifting the separation roller 115 when a medium being a feed target enters the nip part of the feed roller 114 and the separation roller 115 increases, and the feed force required for conveying the medium increases. In particular, abnormal feed of a medium in which a medium is not suitably fed may occur when media come into contact with the outer peripheral surface of the separation roller 115 at a position higher than the central part O.

On the other hand, when a large amount of media are placed on the loading tray 103, the medium conveying apparatus 100 can restrict an amount of media entering a position where the media come into contact with the separation roller 115 by the separation roller cover 123. In particular, by the guide surface 123*a* being located at the same height as the central part O of the separation roller 115, the medium conveying apparatus 100 can prevent a medium from coming into contact with the outer peripheral surface of the separation roller 115 at a position higher than the central part O and thus can suppress occurrence of abnormal feed of a medium.

The extension surface E acquired by extending the guide surface 123*a* may be located below the central part O of the separation roller 115. In other words, the guide surface 123*a* may be formed below the central part O of the separation roller 115 in the height direction. By the guide surface 123*a* being located at a position lower than the central part O of the separation roller 115, the medium conveying apparatus 100 can feed a medium with sufficiently weak feed force.

Figure 8:
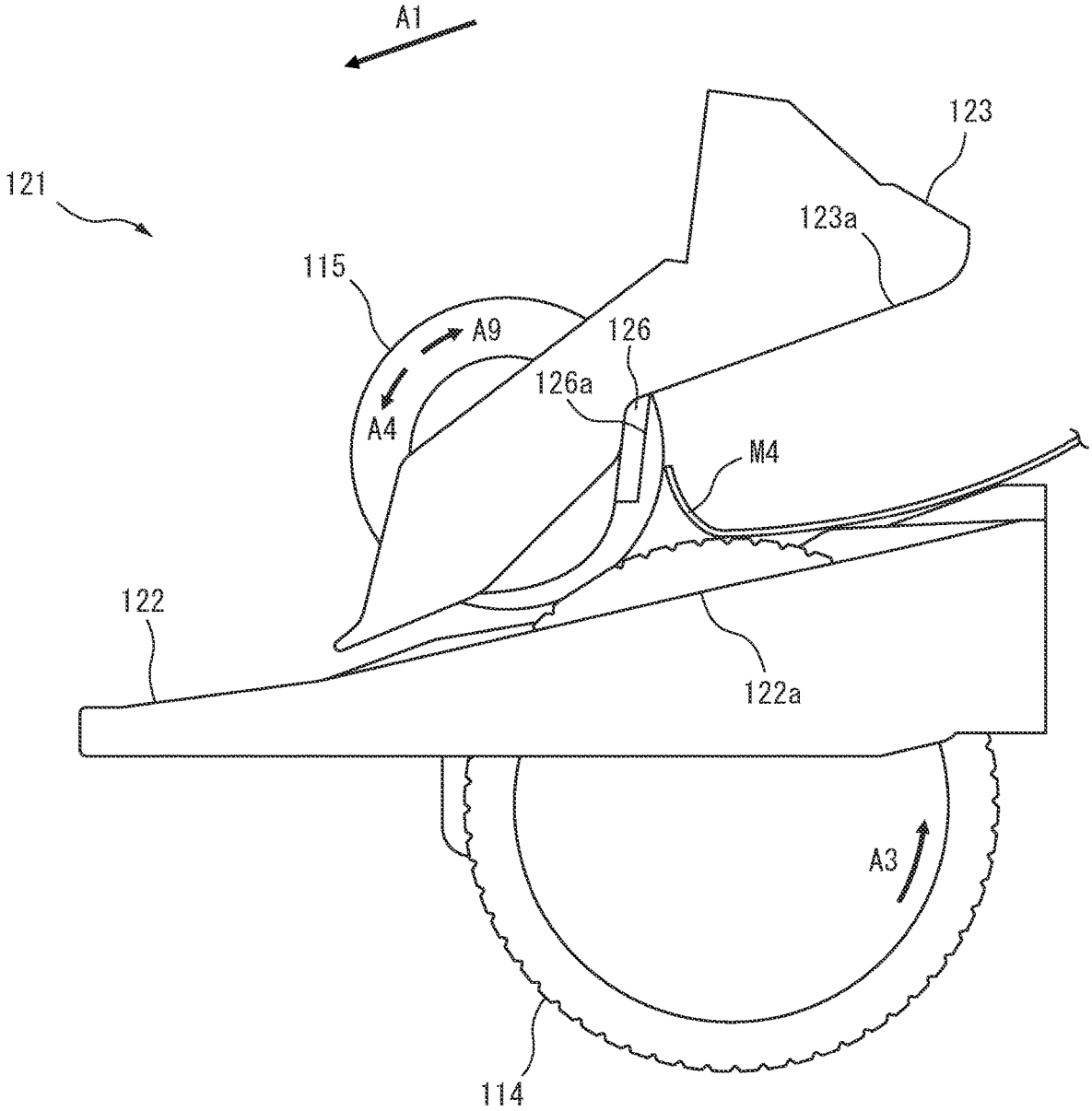
FIG. 8 is a schematic diagram for illustrating an example of a second guide.

FIG. 8 is a schematic diagram for illustrating a second guide when a medium with a curled front edge is placed on a loading tray. FIG. 8 is a schematic diagram of a feeding mechanism viewed from the side at the time of medium feeding when a medium with the curled front edge is placed on a loading tray. In FIG. 8, a first guide and a feed arm 1 is omitted for enhanced visual recognizability.

As described above, when a plurality of media enter between the feed roller 114 and the separation roller 115 in the separation mode, the separation roller 115 rotates in the direction A4 opposite to the medium feeding direction and pushes back a medium not in contact with the feed roller 114. On the other hand, when a sheet of medium enters between the feed roller 114 and the separation roller 115 or when a medium does not exist between the feed roller 114 and the separation roller 115, the separation roller 115 follows the feed roller 114 and rotates in the medium feeding direction A9.

Assuming that the second guide 126 is located on the upstream side of the upstream edge of the separation roller 115 in the medium conveying direction A1, entry of the curled front edge of the medium M4 into the nip part of the feed roller 114 and the separation roller 115 is prevented by the second guide 126. Therefore, the medium M4 does not enter the nip part of the feed roller 114 and the separation roller 115, and a jam of the medium occurs. On the other hand, the second guide 126 is located on the downstream side of the upstream edge of the separation roller 115 in the medium conveying direction A1 in the medium conveying apparatus 100. Therefore, the curled front edge of the medium M4 comes into contact with the separation roller 115 without being blocked by the second guide 126 and enters between the feed roller 114 and the separation roller 115 through guidance of the separation roller 115 rotating in the medium feeding direction A9. Accordingly, the medium conveying apparatus 100 can suppress occurrence of a jam of a medium with a curled front edge.

Figure 9:
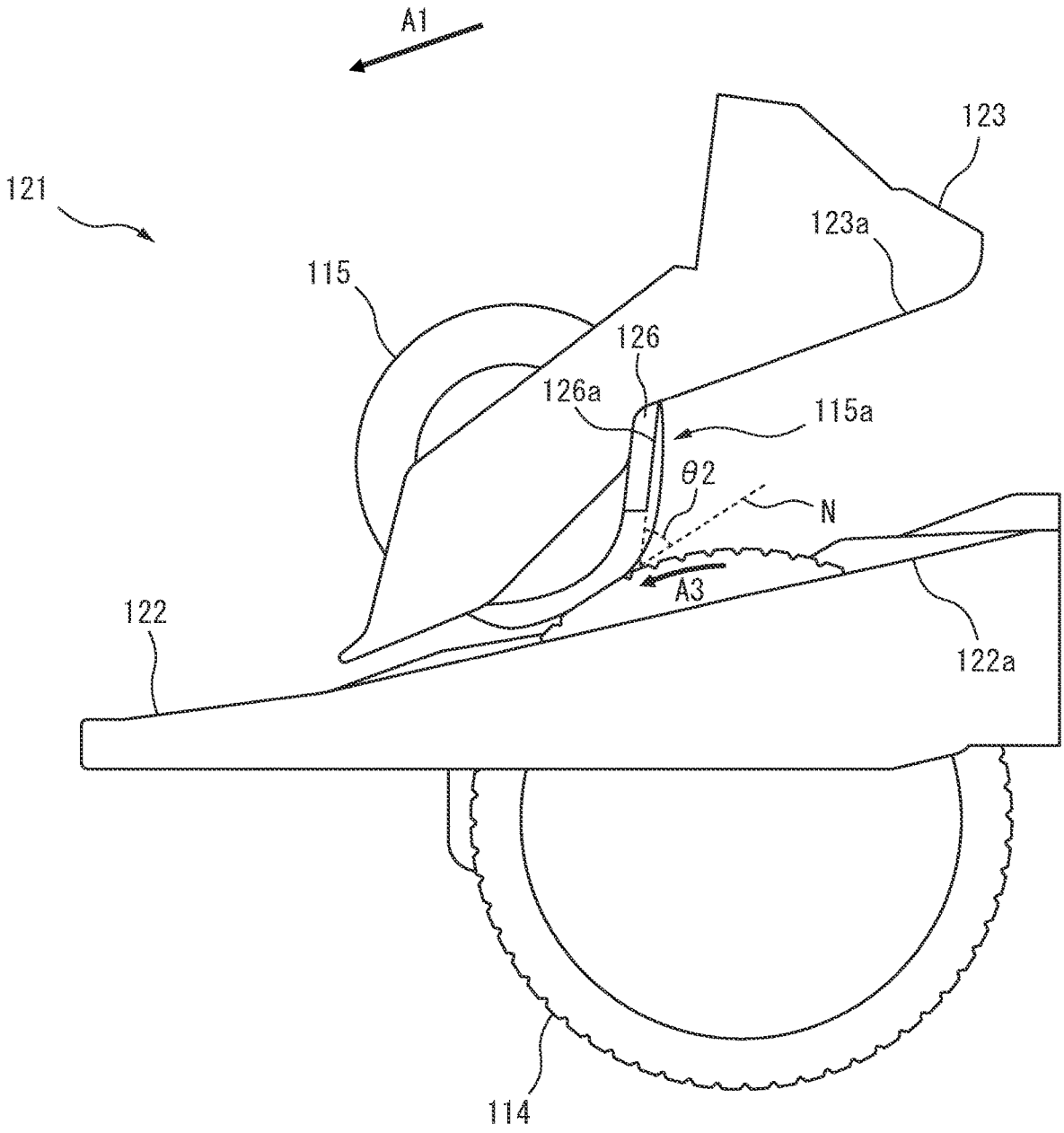
FIG. 9 is a schematic diagram for illustrating tilt of an example of a second guide.

FIG. 9 is a schematic diagram for illustrating tilt of a second guide. FIG. 9 is a schematic diagram of a second guide viewed from the side. In FIG. 9, a first guide and a feed arm is omitted for enhanced visual recognizability.

As illustrated in FIG. 9, the second guide 126 is located in such a way that the contact surface 126*a* coming into contact with the front edge of a medium is tilted relative to the nip surface N of the feed roller 114 and the separation roller 115. In other words, an angle θ2 formed by the contact surface 126*a* of the second guide 126 and the nip surface N is set to be greater than 0° and less than 90°. In particular, the angle θ2 is set to be greater than 45° and less than 90°. Consequently, the front edge of a lower medium out of media in contact with the contact surface 126*a* is placed more on the downstream side, and therefore a medium placed lower is more likely to enter the nip part of the feed roller 114 and the separation roller 115 when being separated from the contact surface 126*a*. Accordingly, the medium conveying apparatus 100 can smoothly feed a medium when medium feeding starts and can reduce the time required for medium feeding.

When the feed roller 114 rotates in the medium feeding direction A3, the separation roller 115 is pulled by the feed roller 114 at the nip part with the feed roller 114. By being pulled by the feed roller 114, the downstream-side edge of the nip part of the separation roller 115 expands, and consequently, the upstream-side edge of the nip part of the separation roller 115 is dented. Accordingly, as illustrated in FIG. 9, a dent 115*a* is formed on the upstream side and the lower side of the outer peripheral surface of the separation roller 115. The contact surface 126*a* of the second guide 126 is located substantially parallel with the dent 115*a* by being tilted relative to the nip surface N, and therefore the front edge of media in contact with the contact surface 126*a* are in contact with the contact surface 126*a* uniformly. Consequently, the second guide 126 can evenly apply a load to each medium in contact and suitably align the front edges of the media. Consequently, the medium conveying apparatus 100 can more satisfactorily feed a medium.

Figure 10:
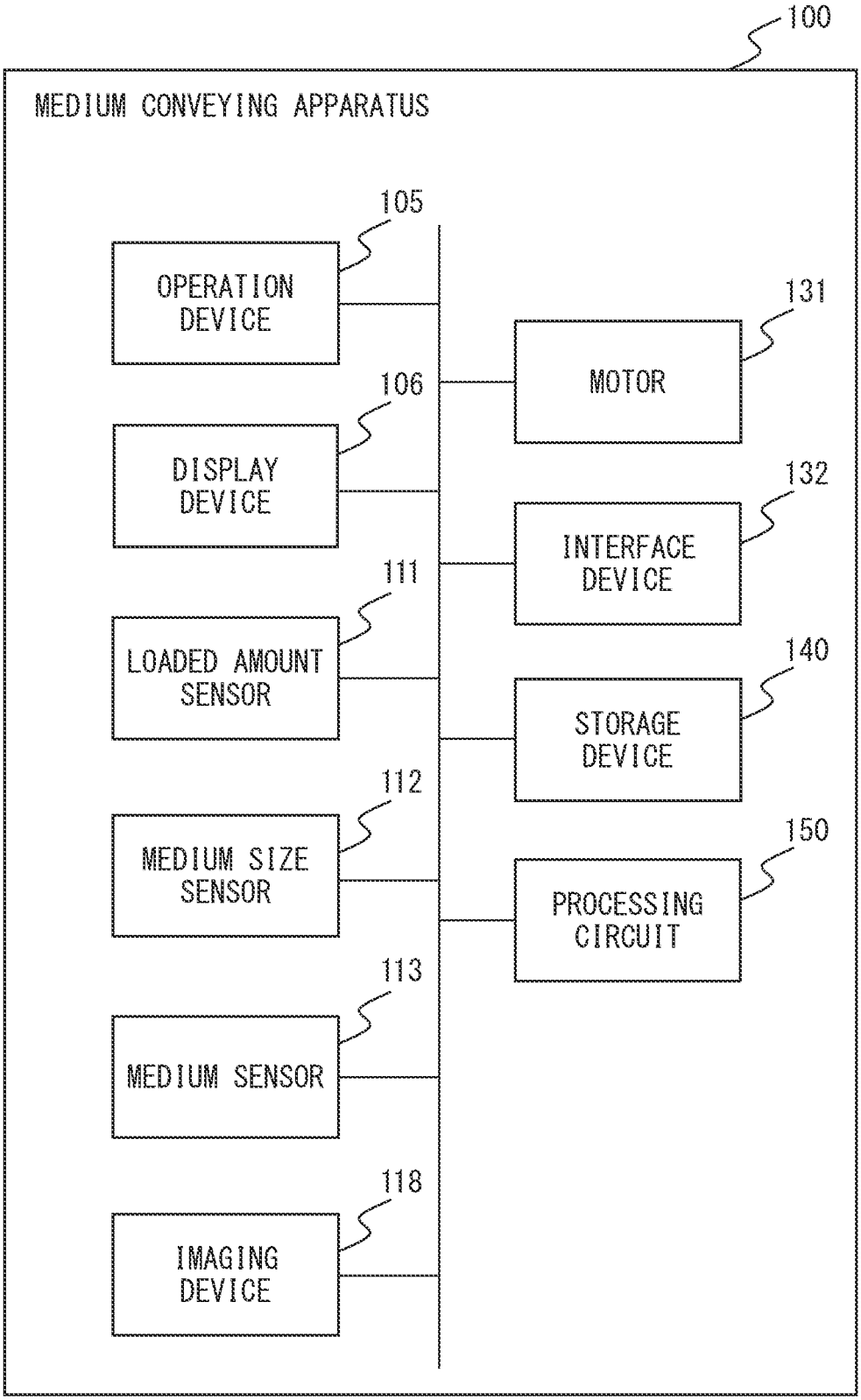
FIG. 10 is a block diagram illustrating a schematic configuration of the medium conveying apparatus 100.

FIG. 10 is a block diagram illustrating a schematic configuration of a medium conveying apparatus.

In addition to the configuration described above, the medium conveying apparatus 100 further includes a motor 131, an interface device 132, a storage device 140, a processing circuit 150, etc.

The motor 131 includes one or a plurality of motors and conveys a medium by rotating the feed roller 114, the separation roller 115, the first conveyance roller 116, the second conveyance roller 117, the first ejection roller 119, and the second ejection roller 120 in accordance with a control signal from the processing circuit 150. One of the first conveyance roller 116 and the second conveyance roller 117 may be a driven roller driven by the other roller. One of the first ejection roller 119 and the second ejection roller 120 may be a driven roller driven by the other roller. The motor 131 moves the bottom surface guide 124 between the first position and the second position in accordance with the control signal from the processing circuit 150.

For example, the interface device 132 includes an interface circuit conforming to a serial bus such as USB and transmits and receives an input image and various types of information by electrical coupling to an information processing apparatus (such as a personal computer or a mobile information terminal). A communication device including an antenna transmitting and receiving wireless signals and a wireless communication interface circuit for transmitting and receiving signals through a wireless communication in accordance with a predetermined communication protocol may be used in place of the interface device 132. For example, the predetermined communication protocol is a wireless local area network (LAN). The communication device may include a wired communication interface circuit for transmitting and receiving signals through a wired communication line in accordance with a communication protocol such as a wired LAN.

The storage device 140 includes a memory device such as a random-access memory (RAM) or a read-only memory (ROM), a fixed disk device such as a hard disk, a portable storage device such as a flexible disk or an optical disk, etc. Further, a computer program, a database, a table, etc., that are used for various types of processing in the medium conveying apparatus 100 are stored in the storage device 140. The computer programs may be installed on the storage device 140 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 150 operates in accordance with a program previously stored in the storage device 140. For example, the processing circuit is a central processing unit (CPU). Examples of the processing circuit 150 that may also be used include a digital signal processor (DSP), a large scale integration (LSI), an application specific integrated circuit (ASIC), and a field-programmable gate array (FPGA).

The processing circuit 150 is connected to the operation device 105, the display device 106, the loaded amount sensor 111, the medium size sensor 112, the medium sensor 113, the imaging device 118, the motor 131, the interface device 132, the storage device 140, etc., and controls the components. The processing circuit 150 performs drive control of the motor 131, imaging control of the imaging device 118, etc., based on the medium signal received from the medium sensor 113, etc., acquires an input image from the imaging device 118, and transmits the acquired image to the information processing apparatus through the interface device 132.

Figure 11:
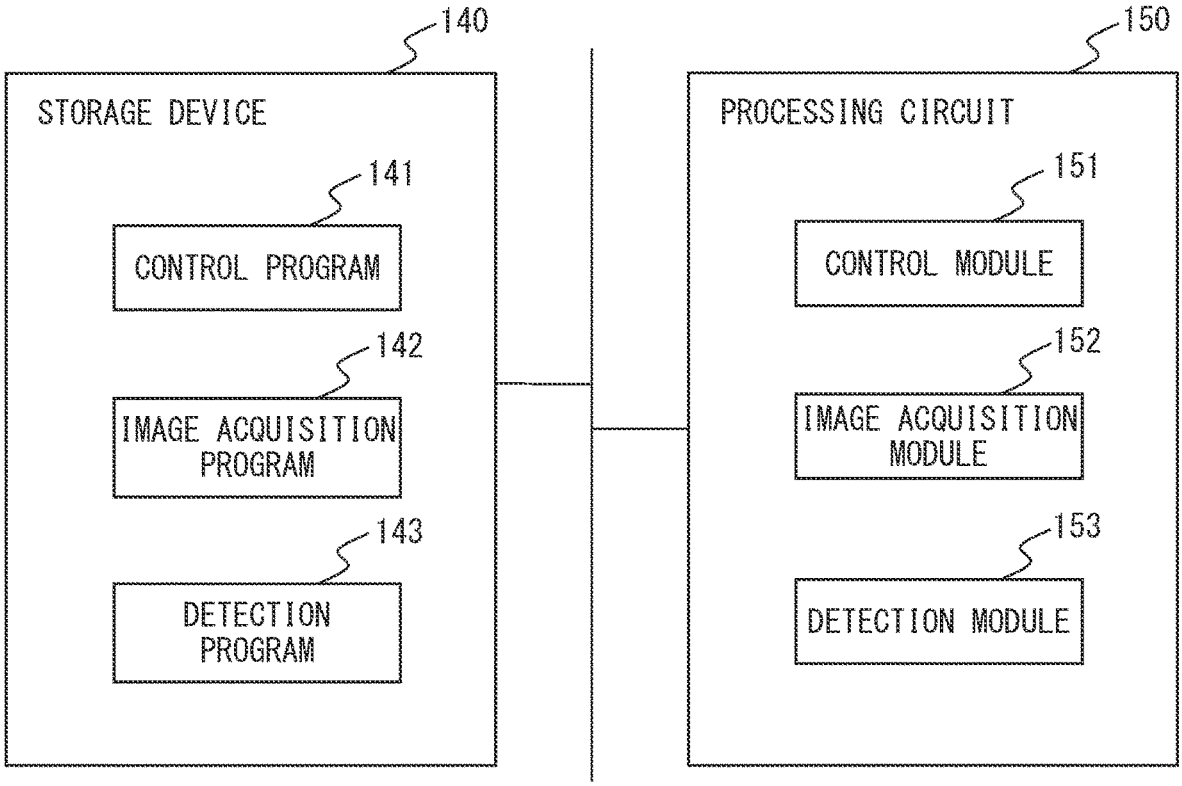
FIG. 11 is a diagram illustrating a schematic configuration of a storage device and a processing circuit.

FIG. 11 is a diagram illustrating a schematic configuration of a storage device and a processing circuit.

As illustrated in FIG. 11, a control program 141, an image acquisition program 142, a detection program 143, etc., are stored in the storage device 140. Each program is a functional module implemented by software operating on the processor. The processing circuit 150 reads each program stored in the storage device 140 and operates in accordance with the read program. Consequently, the processing circuit 150 functions as a control module 151, an image acquisition module 152, and a detection module 153.

Figure 12:
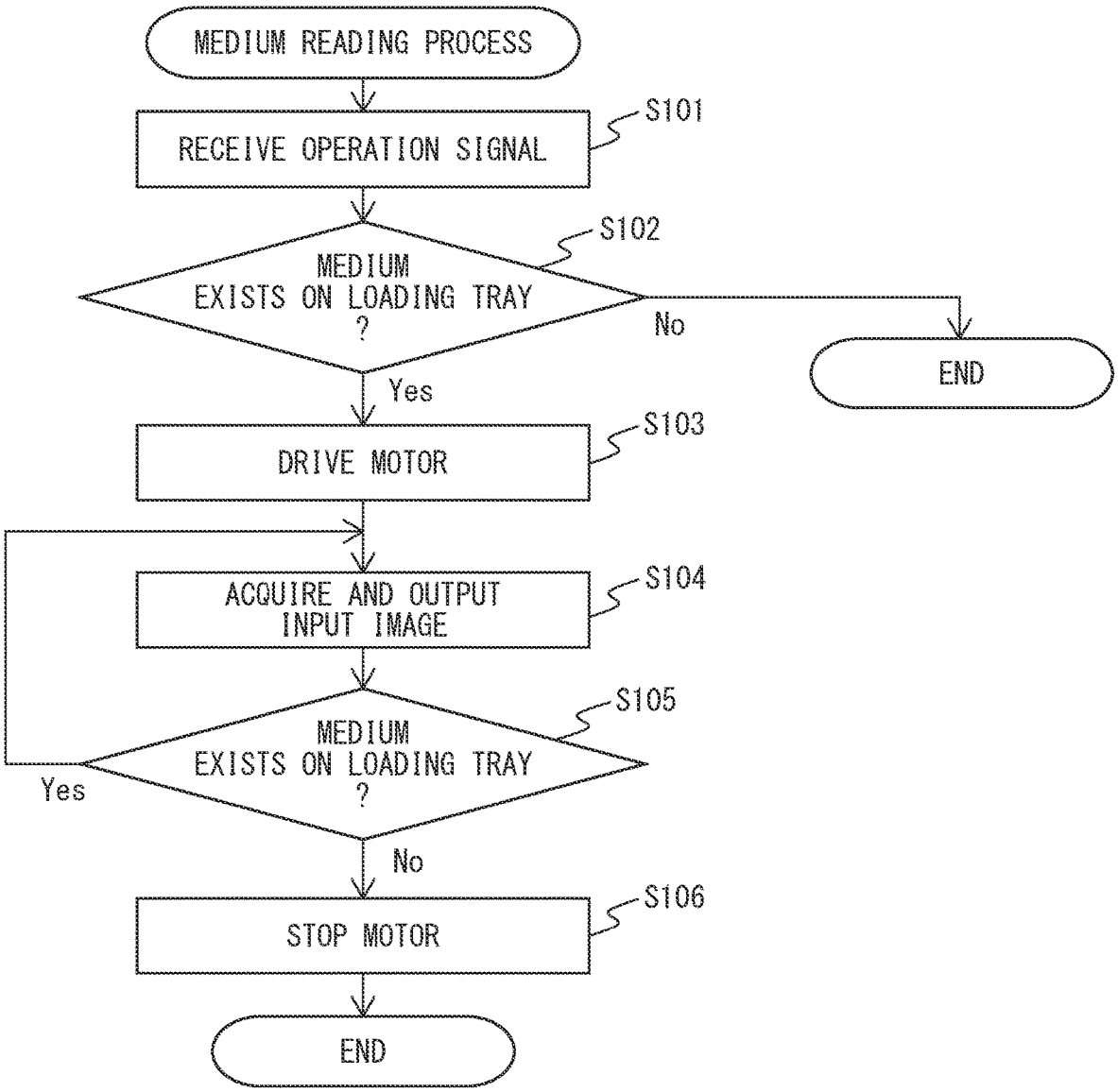
FIG. 12 is a flowchart illustrating an operation example of medium reading process.

FIG. 12 is a flowchart illustrating an operation example of medium reading process in the medium conveying apparatus 100.

The operation example of the medium reading process in the medium conveying apparatus 100 will be described below referring to the flowchart illustrated in FIG. 12. The operation flow described below is executed mainly by the processing circuit 150 in accordance with a program previously stored in the storage device 140 in cooperation with the components in the medium conveying apparatus 100. The bottom surface guide 124 is located at the first position before execution of the flowchart illustrated in FIG. 12, i.e., before medium feeding.

First, the control module 151 waits until an instruction to read a medium is input by a user by using the operation device 105 or the information processing apparatus and an operation signal providing an instruction to read a medium is received from the operation device 105 or the interface device 132 (step S101).

Next, the control module 151 acquires the medium signal from the medium sensor 113 and determines whether a medium is placed on the loading tray 103, based on the acquired medium signal (step S102). When a medium is not placed on the loading tray 103, the control module 151 ends the series of steps.

On the other hand, when a medium is placed on the loading tray 103, the control module 151 moves the bottom surface guide 124 from the first position to the second position by driving the motor 131. Further, the control module 151 conveys the medium by rotating the feed roller 114, the separation roller 115, the first conveyance roller 116, the second conveyance roller 117, the first ejection roller 119, and/or the second ejection roller 120 by driving the motor 131 (step S103).

Next, the image acquisition module 152 acquires an input image from the imaging device 118 by causing the imaging device 118 to image the medium and outputs the acquired input image by transmitting the image to the information processing apparatus through the interface device 132 (step S104).

Next, the control module 151 determines whether a medium remains on the loading tray 103, based on the medium signal received from the medium sensor 113 (step S105). When a medium remains on the loading tray 103, the control module 151 returns the process to step S104 and repeats the process in step S104 and S105.

On the other hand, when a medium does not remain on the loading tray 103, the control module 151 controls the motor 131 to stop the feed roller 114, the separation roller 115, the first conveyance roller 116, the second conveyance roller 117, the first ejection roller 119, and/or the second ejection roller 120. Further, the control module 151 controls the motor 131 to move the bottom surface guide 124 from the second position to the first position (step S106) and ends the series of steps.

As described in detail above, the medium conveying apparatus 100 includes the first guide 125 restricting contact between the front edge of a medium and the separation roller 115 before medium feeding. Furthermore, the medium conveying apparatus 100 includes the second guide 126 being located on the downstream side of the upstream edge of the separation roller 115 and regulating the front edge of a medium at a position above by a predetermined distance from the nip part of the feed roller 114 and the separation roller 115. Consequently, the medium conveying apparatus 100 guides only a suitable amount of media to the nip part from among the media of which restriction by the first guide 125 are released and suppresses pressing of the separation roller 115 by the other media. Consequently, the medium conveying apparatus 100 can suppress reduction in medium separation force due to a rise (lift) of the separation roller 115. Accordingly, the medium conveying apparatus 100 can satisfactorily separate a plurality of media and can suppress occurrence of multi feed of media. Further, the medium conveying apparatus 100 can suppress a medium with a curled front edge from being prevented from entering into the nip part of the feed roller 114 and the separation roller 115 by the second guide 126. Accordingly, the medium conveying apparatus 100 can satisfactorily feed the medium.

In general, as an amount of media placed on the loading tray 103 increases, the force of the media pushing to the separation roller 115 increases and multi feed of media is more likely to occur. By regulating the front edge of a medium at a position above by the predetermined distance from the nip part of the feed roller 114 and the separation roller 115, the medium conveying apparatus 100 can suppress occurrence of multi feed of media and can stably feed a medium regardless of an amount of media placed on the loading tray 103.

The medium conveying apparatus 100 can satisfactorily feed various types of media such as normal paper, thin paper the front edge of which tends to be curled, a card, thick paper, and a passport.

Thus, the medium conveying apparatus 100 can stably feed a medium regardless of the number or the type of media to be fed. Therefore, a user does not need to change a setting of the medium conveying apparatus 100 according to the number or the type of media to be fed, and thus the medium conveying apparatus 100 can improve user convenience. Consequently, the medium conveying apparatus 100 can suppress occurrence of a setting error by a user and thus can suppress occurrence of a malfunction due to a setting error. Further, the medium conveying apparatus 100 does not need to be provided with a special part for feeding a special type of medium or for feeding a large amount of media and thus can suppress increase in the device cost.

Figure 13:
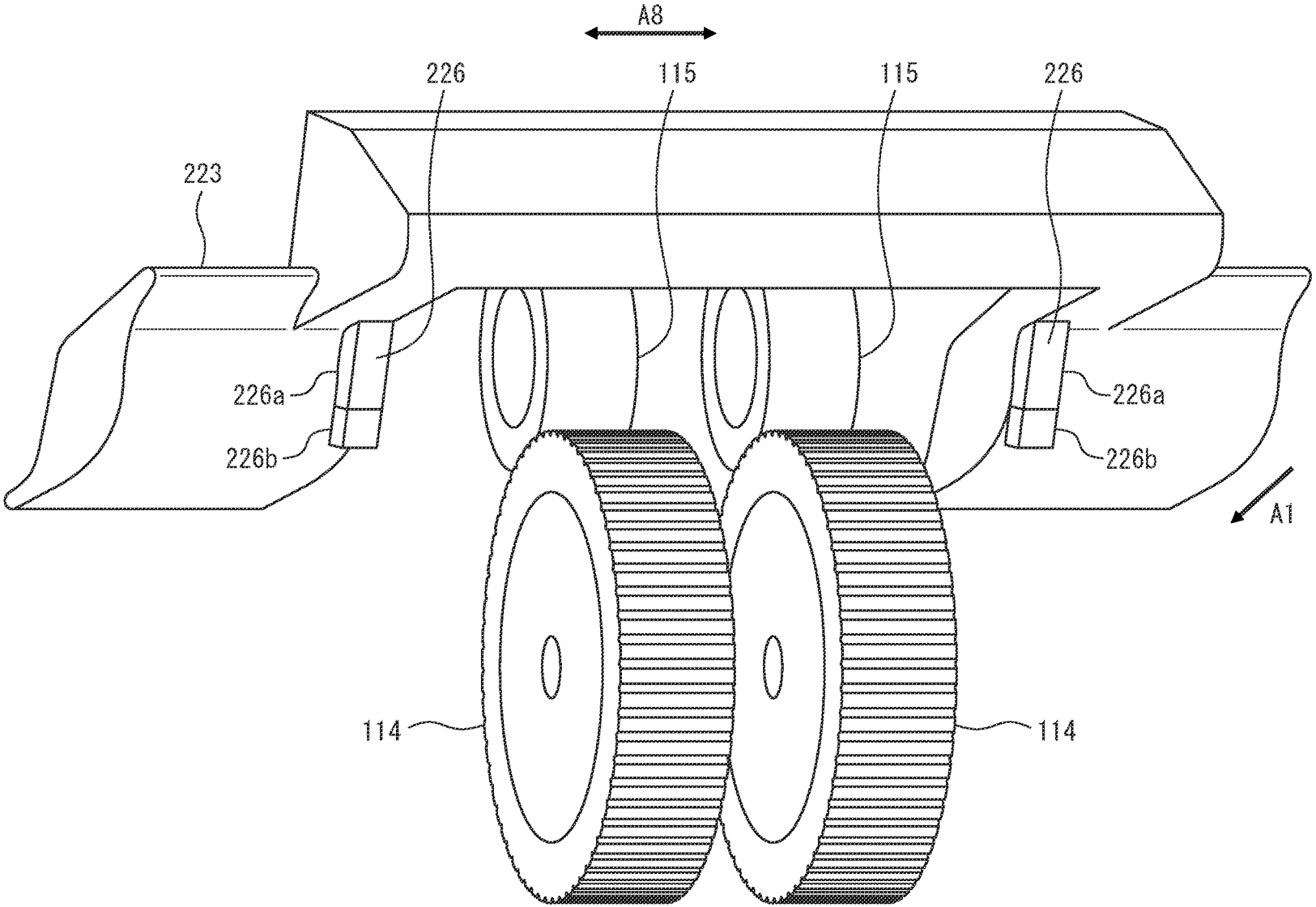
FIG. 13 is a schematic diagram for illustrating another second guide, etc.
Figure 14:
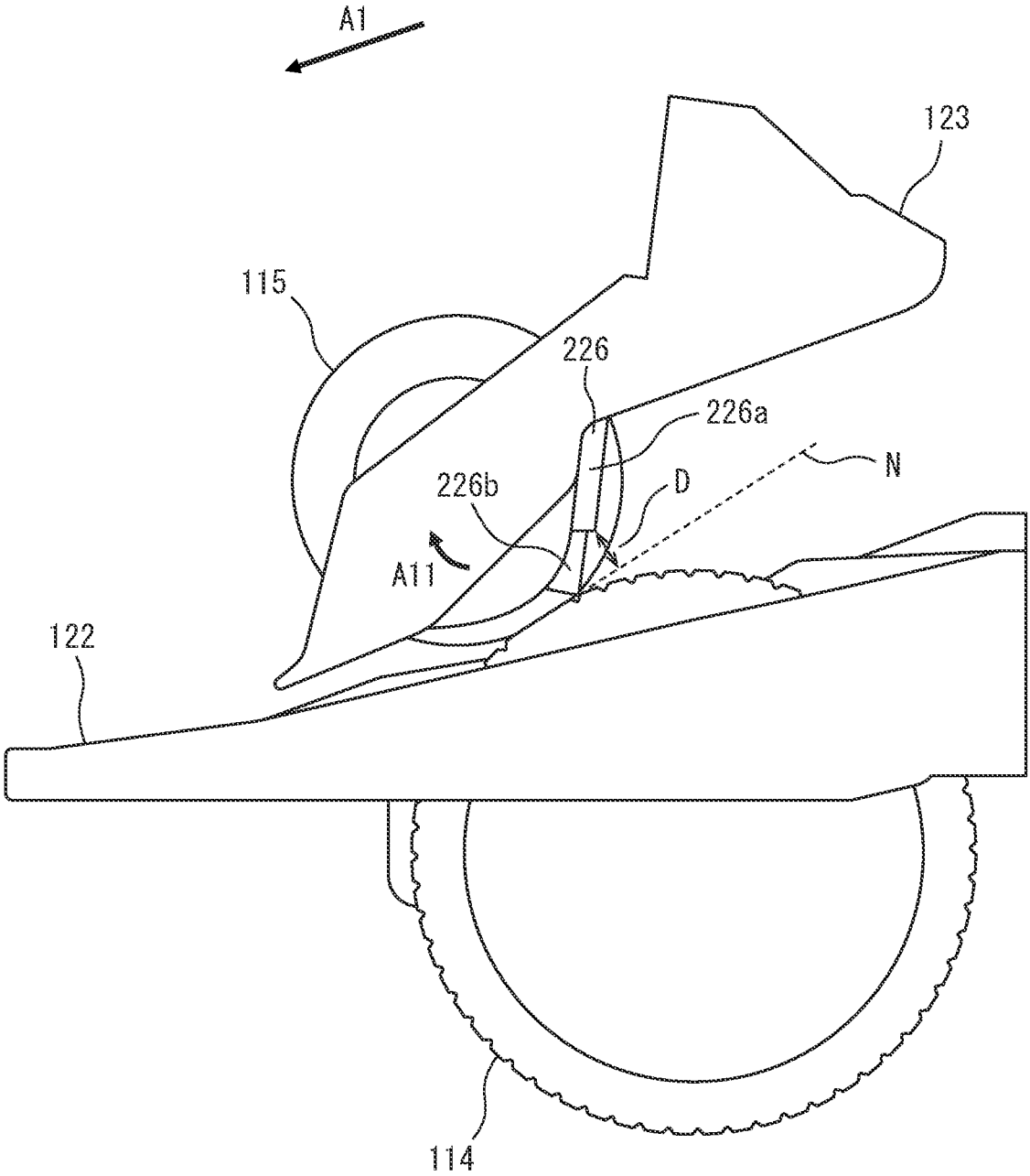
FIG. 14 is a schematic diagram for illustrating another second guide 226, etc.

FIG. 13 and FIG. 14 are schematic diagrams for illustrating a separation roller cover and a second guide in a medium conveying apparatus according to another embodiment. FIG. 13 is a schematic diagram of a separation roller cover viewed from the upstream side. FIG. 14 is a schematic diagram of a separation roller cover viewed from the side. In FIG. 13 and FIG. 14, a guide member is omitted for enhanced visual recognizability.

As illustrated in FIG. 13 and FIG. 14, the medium conveying apparatus according to the present embodiment includes the separation roller cover 223 and the second guide 226 in place of the separation roller cover 123 and the second guide 126.

The separation roller cover 223 and the second guide 226 have structures similar to those of the separation roller cover 123 and the second guide 126. However, the second guide 226 includes a fixed part 226*a* and a moving part 226*b*. The fixed part 226*a* is provided to be fixed to the separation roller cover 223. The fixed part 226*a* is provided above by a predetermined distance D from a nip surface N being an extension surface of a nip part of a feed roller 114 and a separation roller 115. The moving part 226*b* is provided between the fixed part 226*a* and the nip part of the feed roller 114 and the separation roller 115 to be movable by the front edge of a fed medium. The moving part 226*b* is provided at the lower end of the fixed part 226*a* to be swingable (rotatable) to the downstream side (in a direction of an arrow A11 in FIG. 14) and is pressed to the upstream side (in a direction opposite to the arrow A11) by an elastic member such as a helical torsion coil spring.

When a plurality of media are placed on the loading tray 103, force toward the downstream side is provided to each medium by the feed roller 114 and force toward the upstream side is provided by the separation roller 115. The pressing force exerted on the moving part 226*b* by the elastic member is set to be weaker than the force exerted toward the downstream side on a medium in contact with the feed roller 114 and stronger than the force exerted toward the downstream side on a medium not in contact with the feed roller 114. Consequently, when a plurality of media are placed on the loading tray 103, a medium being a feed target is guided to the nip part of the feed roller 114 and the separation roller 115 while entry of another medium into the nip part is prevented. Accordingly, the second guide 226 can suppress occurrence of multi feed of media while satisfactorily guiding a medium (including a card, etc.) being a feed target to the nip part of the feed roller 114 and the separation roller 115.

As described in detail above, the medium conveying apparatus can satisfactorily feed a medium when the second guide 226 includes the fixed part 226*a* and the moving part 226*b* as well.

Figure 15:
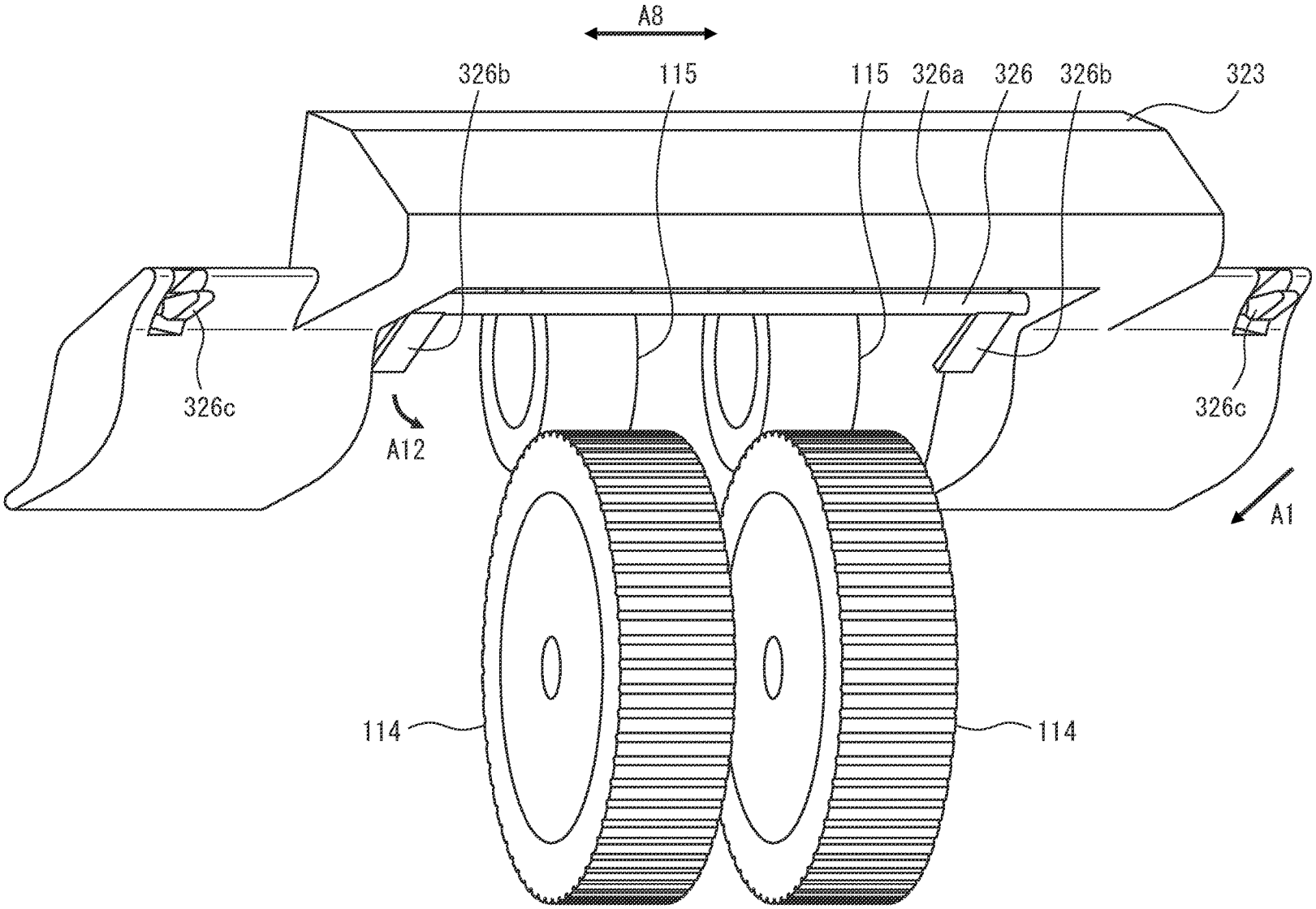
FIG. 15 is a schematic diagram for illustrating yet another second guide, etc.
Figure 16:
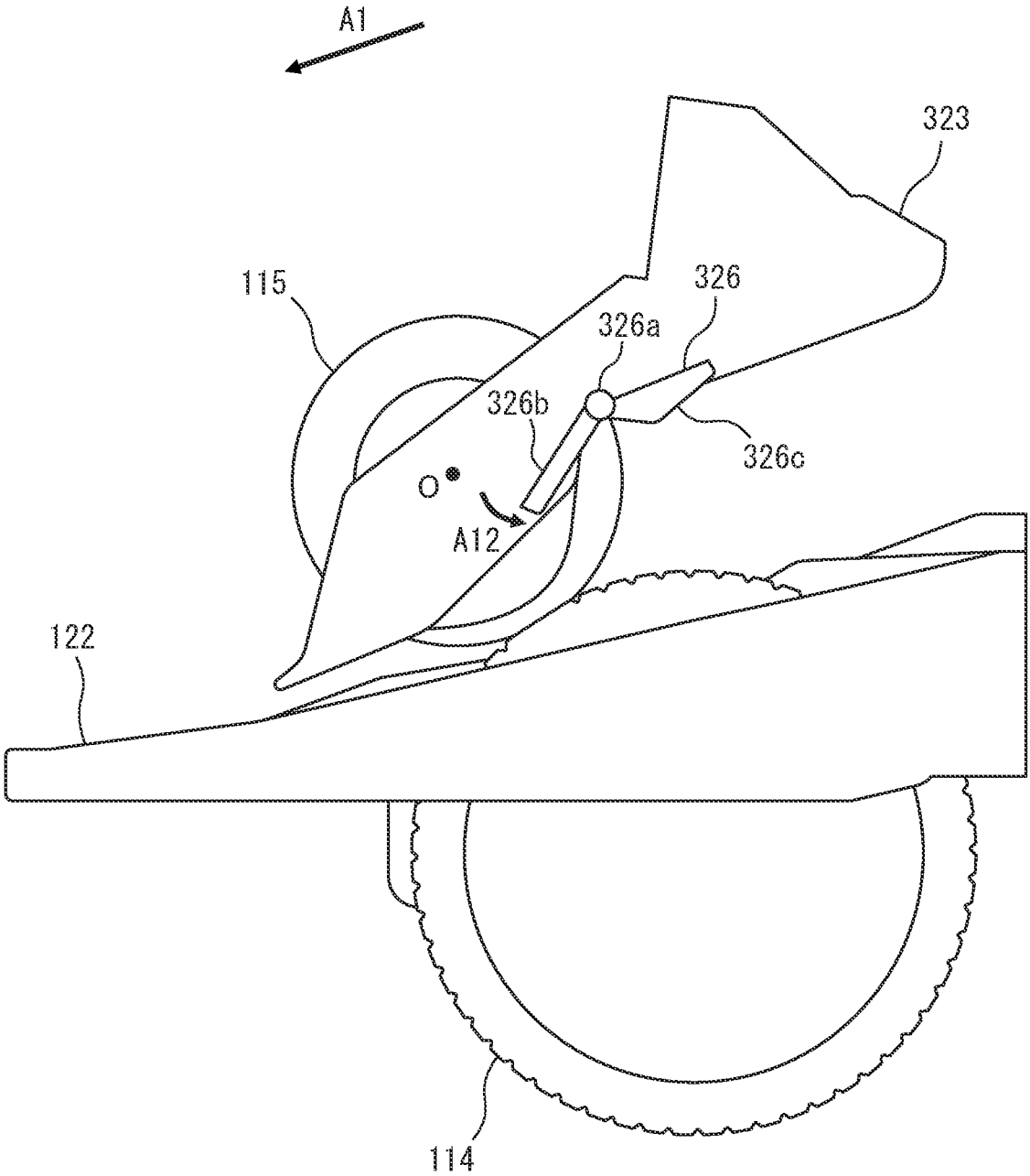
FIG. 16 is a schematic diagram for illustrating yet another second guide, etc.

FIG. 15 and FIG. 16 are schematic diagrams for illustrating a separation roller cover and a second guide in a medium conveying apparatus according to yet another embodiment FIG. 15 is a schematic diagram of a separation roller cover viewed from the upstream side. FIG. 16 is a schematic diagram of a separation roller cover viewed from the side. In FIG. 15 and FIG. 16, a guide member is omitted for enhanced visual recognizability. FIG. 15 and FIG. 16 illustrate the second guide 326 before medium feeding (in an initial state).

As illustrated in FIG. 15 and FIG. 16, the medium conveying apparatus according to the present embodiment includes the separation roller cover 323 and the second guide 326 in place of the separation roller cover 123 and the second guide 126.

The separation roller cover 323 and the second guide 326 have structures similar to those of the separation roller cover 123 and the second guide 126. However, the second guide 326 includes a shaft 326*a*, a contact part 326*b*, and an arm 326*c*. In the example illustrated in FIG. 15 and FIG. 16, the second guide 326 includes two each of the contact parts 326*b* and the arms 326*c*.

The shaft 326*a* is provided on the separation roller cover 323 to be rotatable around a rotation axis extending in a width direction A2 and is pressed toward the upstream side (in a direction opposite to an arrow A12) by an elastic member such as a helical torsion coil spring.

The contact part 326*b* includes a first contact surface coming into contact with the front edge of a fed medium and is provided on the shaft 326*a* to be rotatable (swingable) according to rotation of the shaft 326*a*. The first contact surface is located at a noncontacting position (an arrangement position illustrated in FIG. 15 and FIG. 16) where the surface does not come into contact with the front edge of a medium before medium feeding (in an initial state). The contact part 326*b* is located outer side than the first guide 125 and close to a separation roller 115 in the width direction A2 perpendicular to a medium conveying direction. The contact parts 326*b* are located at substantially identical positions in the medium conveying direction A1. The contact parts 326*b* are spaced in the width direction A2 at intervals of a length acquired by adding a margin to a width of a minimum medium size supported by the medium conveying apparatus.

The arm 326*c* includes a second contact surface coming into contact with the top surface of a fed medium and is provided on the shaft 326*a* to rotate the shaft 326*a* according to movement (swinging) of the arm 326*c*. The arms 326*c* are located outer side than the contact parts 326*b* in the width direction A2 perpendicular to the medium conveying direction. The arms 326*c* are spaced at intervals of a length greater than the length of an ID-1-based ID card defined by the ISO/IEC 7810 in a lengthwise direction (85.6 mm) or the length of a passport in a folded state in the lengthwise direction (125 mm). The arms 326*c* are located at substantially identical positions in the medium conveying direction A1.

Figure 17:
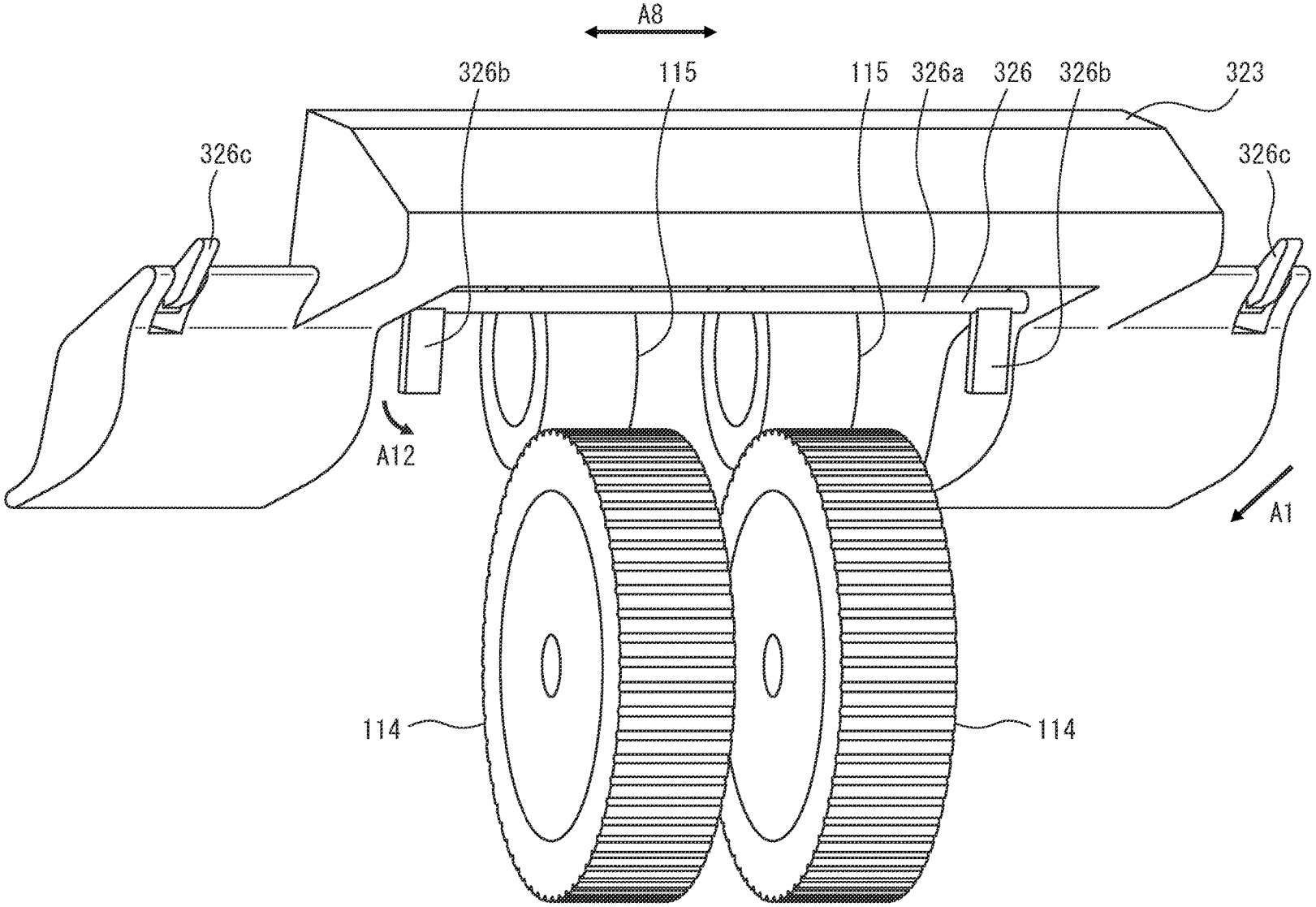
FIG. 17 is a schematic diagram for illustrating yet another second guide, etc.
Figure 18:
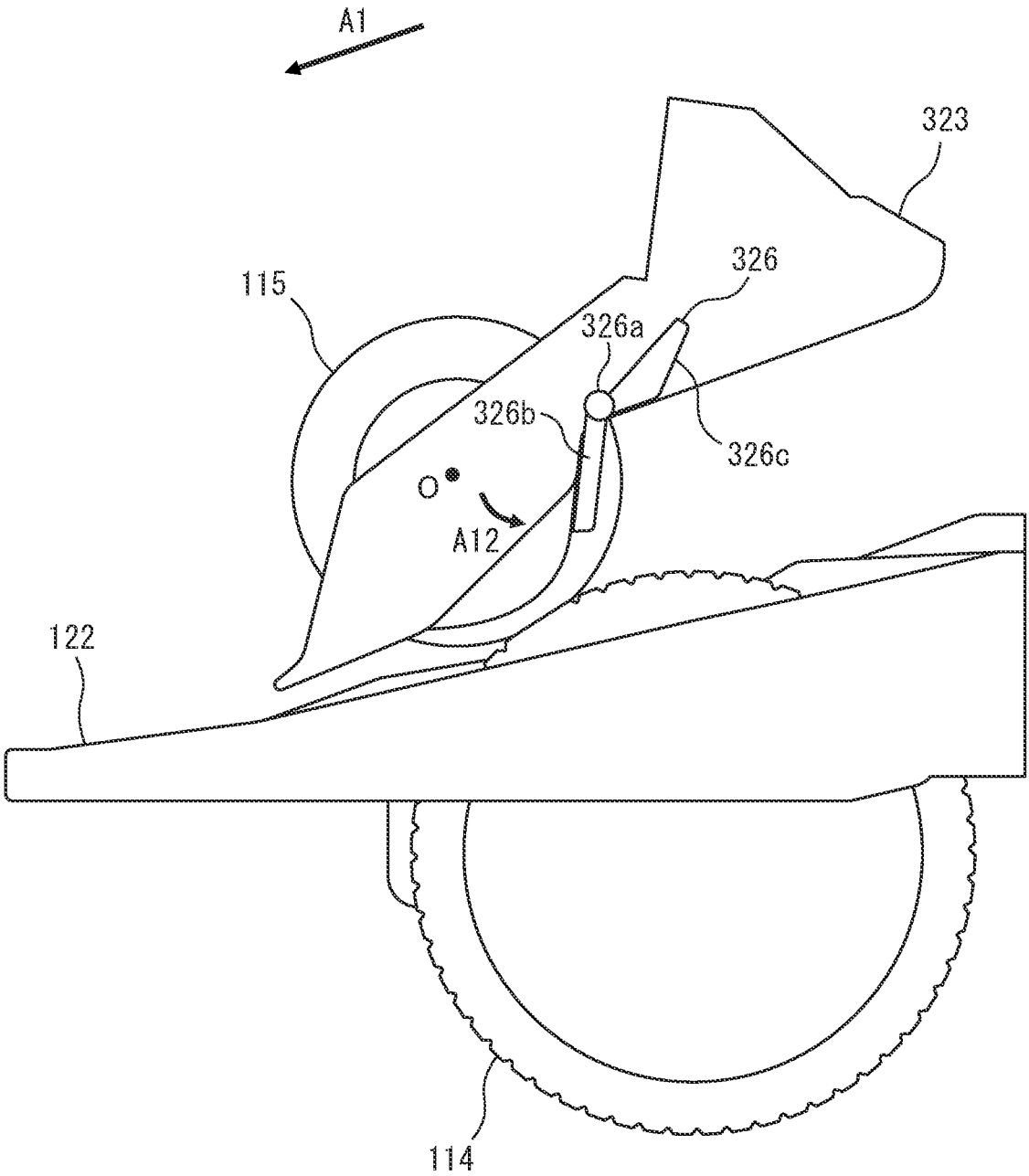
FIG. 18 is a schematic diagram for illustrating yet another second guide, etc.

FIG. 17 and FIG. 18 are schematic diagrams for illustrating a second guide in a state where a contact part is set. FIG. 17 is a schematic diagram of a separation roller cover viewed from the upstream side. FIG. 18 is a schematic diagram of the separation roller cover viewed from the side. In FIG. 17 and FIG. 18, a guide member is omitted for enhanced visual recognizability.

As illustrated in FIG. 17 and FIG. 18, when a bundle of medium with a height greater than or equal to a predetermined height is placed on a loading tray 103 and the top surface of the bundle of medium comes into contact with the second contact surface of the arm 326*c*, the arm 326*c* is pushed up by the bundle of medium and moves upward. The shaft 326*a* rotates in the direction of the arrow A12 with the upward movement of the arm 326*c*, and the contact part 326*b* swings in the direction of the arrow A12 with the rotation of the shaft 326*a*. Consequently, the contact surface of the contact part 326*b* is set to a contact position (an arrangement position illustrated in FIG. 17 and FIG. 18) where the surface comes into contact with the front edge of a fed medium.

The contact part 326*b* set at the contact position is provided above a nip part of a feed roller 114 and the separation roller 115 and is located in such a way as not to overlap the feed roller 114 viewed from the width direction A2 perpendicular to the medium conveying direction. Further, the contact part 326*b* set at the contact position is located between the upstream edge of the separation roller 115 in the medium conveying direction A1 and a central part O of the separation roller 115, in the medium conveying direction A1.

Thus, the second guide 326 is provided to be movable by a medium coming into contact with the separation roller 115 when the height of the medium is greater than or equal to the predetermined height. Consequently, when a bundle of medium with a width longer than the distance between the two arms 326*c* and a height contacting with the arms 326*c* is placed on the loading tray 103, the second guide 326 prevents the bundle of medium from entering the downstream side by contacting with the front edge of the bundle of medium. Accordingly, the second guide 326 can suppress reduction in medium separation force due to the separation roller 115 being raised (lifted) by the bundle of medium. On the other hand, when a medium with a width shorter than the arrangement interval of the arms 326*c*, such as an ID card or a passport, is placed on the loading tray 103, the arm 326*c* does not come into contact with the medium, and therefore the contact part 326*b* is located at the noncontacting position. Therefore, the contact part 326*b* can satisfactorily feed a medium with a thickness of an ID card, a passport, etc, without preventing feeding of the medium.

As described in detail above, the medium conveying apparatus can satisfactorily feed a medium even when the second guide 326 is provided to be movable according to the height of the medium.

Figure 19:
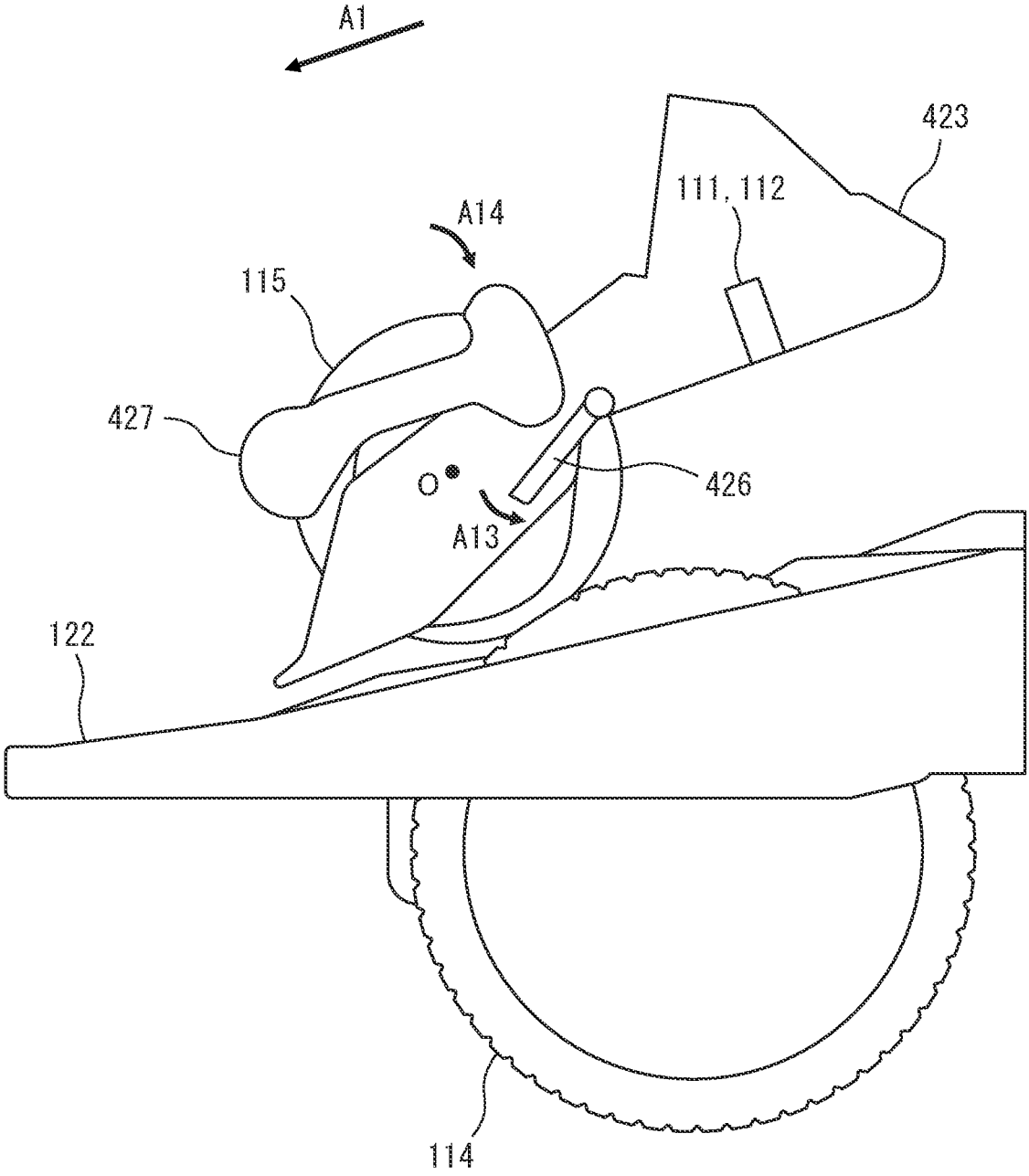
FIG. 19 is a schematic diagram for illustrating another second guide, etc.

FIG. 19 is a schematic diagram for illustrating a separation roller cover 423 and a second guide 426 in a medium conveying apparatus according to yet another embodiment. FIG. 19 is a schematic diagram of a separation roller cover viewed from the side. In FIG. 19, a guide member is omitted for enhanced visual recognizability. FIG. 19 illustrates a second guide before medium feeding (in an initial state).

As illustrated in FIG. 19, the medium conveying apparatus according to the present embodiment includes the separation roller cover 423, the second guide 426, and a cam 427 in place of the separation roller cover 123 and the second guide 126.

The separation roller cover 423 and the second guide 426 have structures similar to those of the separation roller cover 123 and the second guide 126. However, the second guide 426 is provided on the separation roller cover 423 to be swingable (rotatable) to the upstream side (in a direction of an arrow A13 in FIG. 19) and is pressed to the downstream side (in a direction opposite to the arrow A13) by an elastic member such as a helical torsion coil spring. The second guide 426 is located at a noncontacting position (an arrangement position illustrated in FIG. 19) where the guide does not come into contact with the front edge of a medium before medium feeding (in an initial state).

The cam 427 is provided on the separation roller cover 423 to be swingable (rotatable) to a direction of an arrow A14 in FIG. 19 by the driving force of a motor 131. The cam 427 is located at a position separate from the second guide 426 before medium feeding (in the initial state).

Figure 20:
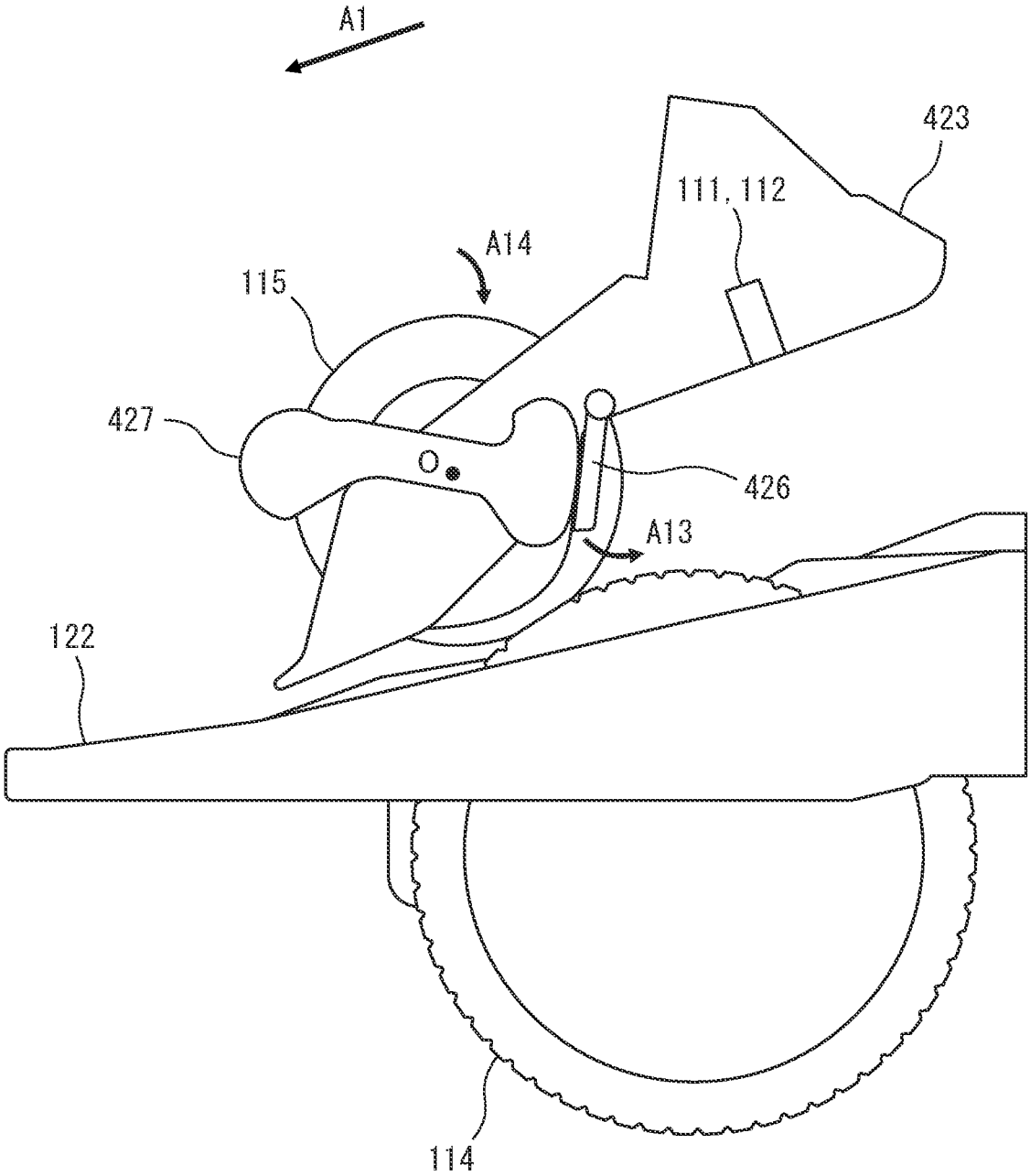
FIG. 20 is a schematic diagram for illustrating yet another second guide, etc.

FIG. 20 is a schematic diagram for illustrating a second guide in a set state. FIG. 20 is a schematic diagram of a separation roller cover viewed from the side. In FIG. 20, a guide member is omitted for enhanced visual recognizability.

As illustrated in FIG. 20, when the cam 427 rotates in the direction of the arrow A14 by the driving force of the motor 131 and comes into contact with the second guide 426, the second guide 426 swings to the upstream side (in the direction of the arrow A13) by the cam 427. Consequently, the second guide 426 is set to a contact position (a placement position illustrated in FIG. 20) where the guide comes into contact with the front edge of a fed medium.

The second guide 426 is provided above a nip part of a feed roller 114 and a separation roller 115 at the contact position and is located in such a way as not to overlap the feed roller 114 viewed from a width direction A2 perpendicular to a medium conveying direction. Further, the second guide 426 set at the contact position is located between the upstream edge of the separation roller 115 in a medium conveying direction A1 and a central part O of the separation roller 115, in the medium conveying direction A1.

The second guide 426 feeds a medium without preventing medium feeding when being located at the noncontacting position while coming into contact with the front edge of a medium and preventing entry of the medium into the downstream side when being located at the contact position.

Figure 21:
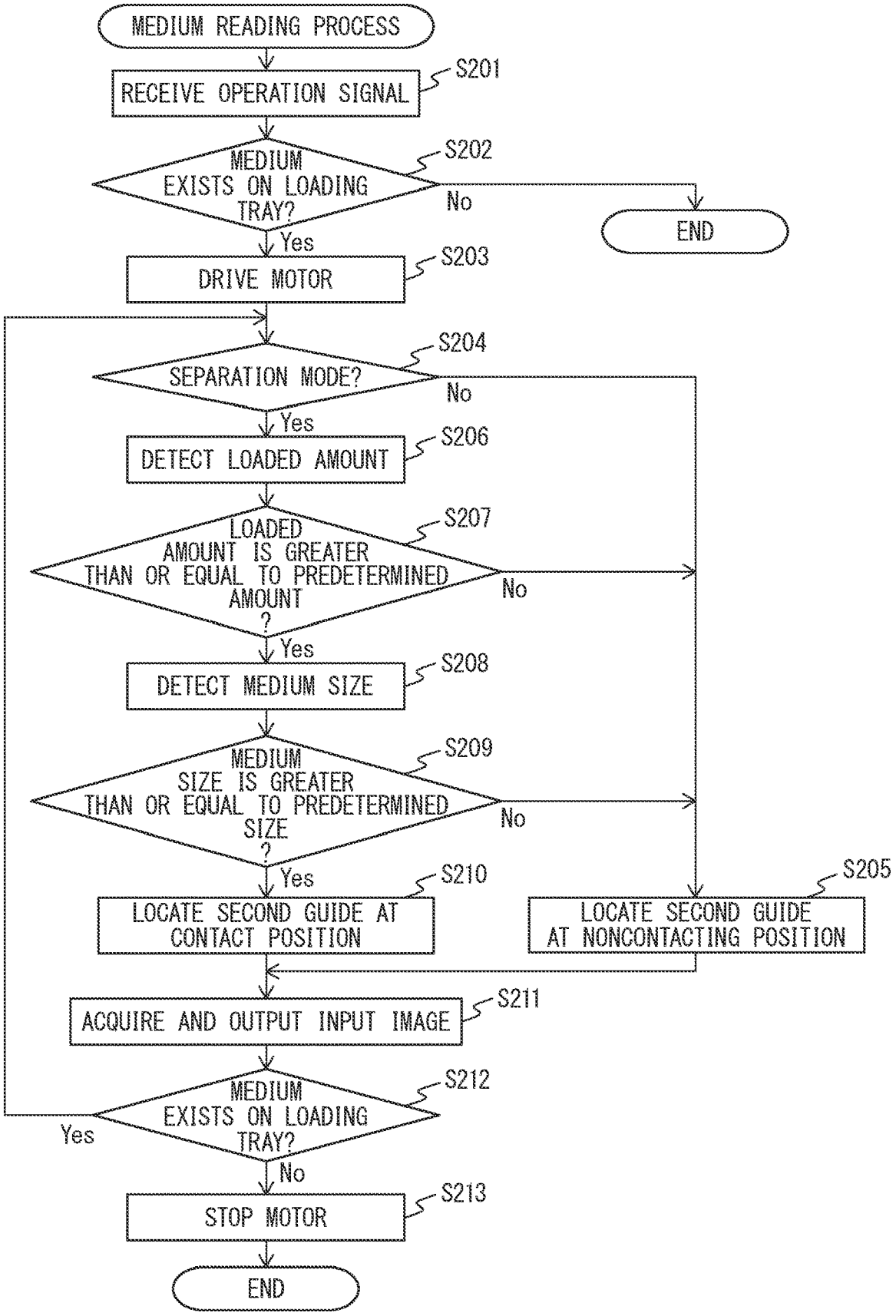
FIG. 21 is a flowchart illustrating an operation example of another type of medium reading process.

FIG. 21 is a flowchart illustrating an operation example of medium reading process in the medium conveying apparatus including a second guide and a cam.

The operation example of the medium reading process in the medium conveying apparatus will be described below referring to the flowchart illustrated in FIG. 21. The operation flow described below is executed mainly by a processing circuit 150 in accordance with a program previously stored in a storage device 140 in cooperation with the components in the medium conveying apparatus. The flowchart illustrated in FIG. 21 is executed in place of the flowchart illustrated in FIG. 12. Processing in steps S201 to S203 and S211 to S213 in the flowchart illustrated in FIG. 21 is similar to the processing in steps S101 to S103 and S104 to S106 in the flowchart illustrated in FIG. 12, and therefore description thereof is omitted. Only processing in steps S204 to S210 will be described below. The second guide 426 is located at the noncontacting position before the flowchart illustrated in FIG. 21 is executed, i.e., before medium feeding.

In step S204, a control module 151 determines whether the feed mode is set to a separation mode or a non-separation mode (step S204).

When the feed mode is set to the non-separation mode, the control module 151 locates the second guide 426 at the noncontacting position by driving the motor 131 (step S205) and moves the process to step S211. Thus, the control module 151 retracts the second guide 426 when the medium conveying apparatus 100 operates in the non-separation mode. Consequently, when a booklet with some thickness, such as a passport, is fed in the non-separation mode, the control module 151 can satisfactorily feed the booklet by retracting the second guide 426. When the second guide 426 is already located at the noncontacting position, the control module 151 does not particularly execute processing and moves the process to step S211.

On the other hand, when the feed mode is set to the separation mode, a detection module 153 receives a loaded amount signal from the loaded amount sensor 111 and detects a loaded amount of media placed on a loading tray 103, based on the received loaded amount signal (step S206). The medium conveying apparatus previously stores a table indicating a relation between the signal value of a loaded amount signal and a loaded amount (height or weight) of media into the storage device 140. The detection module 153 specifies a loaded amount related to the signal value of the received loaded amount signal as a loaded amount of the media placed on the loading tray 103 with reference to the table.

Next, the control module 151 determines whether the detected loaded amount is greater than or equal to a predetermined amount (step S207). The predetermined amount is preset to a loaded amount requiring regulation of media by the second guide 426.

When the loaded amount is less than the predetermined amount, the control module 151 locates the second guide 426 at the noncontacting position by driving the motor 131 (step S205) and moves the process to step S211. When the second guide 426 is already located at the noncontacting position, the control module 151 does not particularly execute processing and moves the process to step S211.

On the other hand, when the loaded amount is greater than or equal to the predetermined amount, the detection module 153 receives medium size signals from medium size sensors 112 and detects the size of a medium placed on the loading tray 103, based on the received medium size signals (step S208). When the medium size signal indicates whether a medium exists at a position facing each light emitter and each light receiver, the detection module 153 detects an arrangement interval between two sets of a light emitter and a light receiver at the outermost positions among sets whose light emitter and light receiver face a medium, as the size of the medium in the width direction A2. When the medium size signal indicates whether a medium exists at a position facing each contact detection sensor, the detection module 153 detects an arrangement interval of two sensors at the outermost positions among sensors which face a medium, as the size of the medium in the width direction A2. When the medium size signal is an image signal, the detection module 153 detects the size of the medium in the medium conveying direction A1 and/or the width direction A2 based on the image signal by using a known image processing technology.

Next, the control module 151 determines whether the detected size of the medium is greater than or equal to a predetermined size (step S209). For example, the predetermined size is set to a size acquired by adding a margin to the length of an ID-1-based ID card defined by the ISO/IEC 7810 in the lengthwise direction (85.6 mm) or the length of a passport in a folded state in the lengthwise direction (125 mm). When the sizes of the medium in the medium conveying direction A1 and in the width direction A2 are detected by the detection module 153, the control module 151 determines whether a longer size of the detected sizes of the medium is greater than or equal to the predetermined size. In that case, the control module 151 may determine whether a shorter size of the detected sizes of the medium is greater than or equal to the predetermined size.

When the size of the medium is less than the predetermined size, the control module 151 locates the second guide 426 at the noncontacting position by driving the motor 131 (step S205) and moves the process to step S211. When the second guide 426 is already located at the noncontacting position, the control module 151 does not particularly execute processing and moves the process to step S211.

On the other hand, when the size of the medium is greater than or equal to the predetermined size, the control module 151 locates the second guide 426 at the contact position by driving the motor 131 (step S210). When the second guide 426 is already located at the contact position, the control module 151 does not particularly execute processing and moves the process to step S211.

Thus, the control module 151 moves the second guide 426 according to a loaded amount of media placed on the loading tray 103. Consequently, the control module 151 can retract the second guide 426 when the loaded amount of the media is small while setting the second guide 426 when the loaded amount of the media is large. Accordingly, the control module 151 can suppress occurrence of a jam of a medium with a curled front edge by the second guide 426 when the loaded amount of the media is small while satisfactorily separating a medium when the loaded amount of the media is large.

The control module 151 moves the second guide 426 according to the size of a medium placed on the loading tray 103. Consequently, the control module 151 can set the second guide 426 when common paper, etc., is fed while retracting the second guide 426 when a small-sized medium with some thickness, such as a passport or a card, is fed. Accordingly, the control module 151 can satisfactorily separate common paper, etc., while satisfactorily feeding a small-sized medium with some thickness, such as a passport or a card.

The control module 151 may place the second guide 426 at the contact position when at least one of conditions that a loaded amount is greater than or equal to the predetermined amount and the size of a medium is greater than or equal to the predetermined size is satisfied. The processing in step S204 may be omitted. The processing in steps S206 and S207 and/or steps S208 and S209 may be omitted.

As described in detail above, the medium conveying apparatus can satisfactorily feed a medium when the second guide 426 is provided to be movable in accordance with control by the control module 151.

Figure 22:
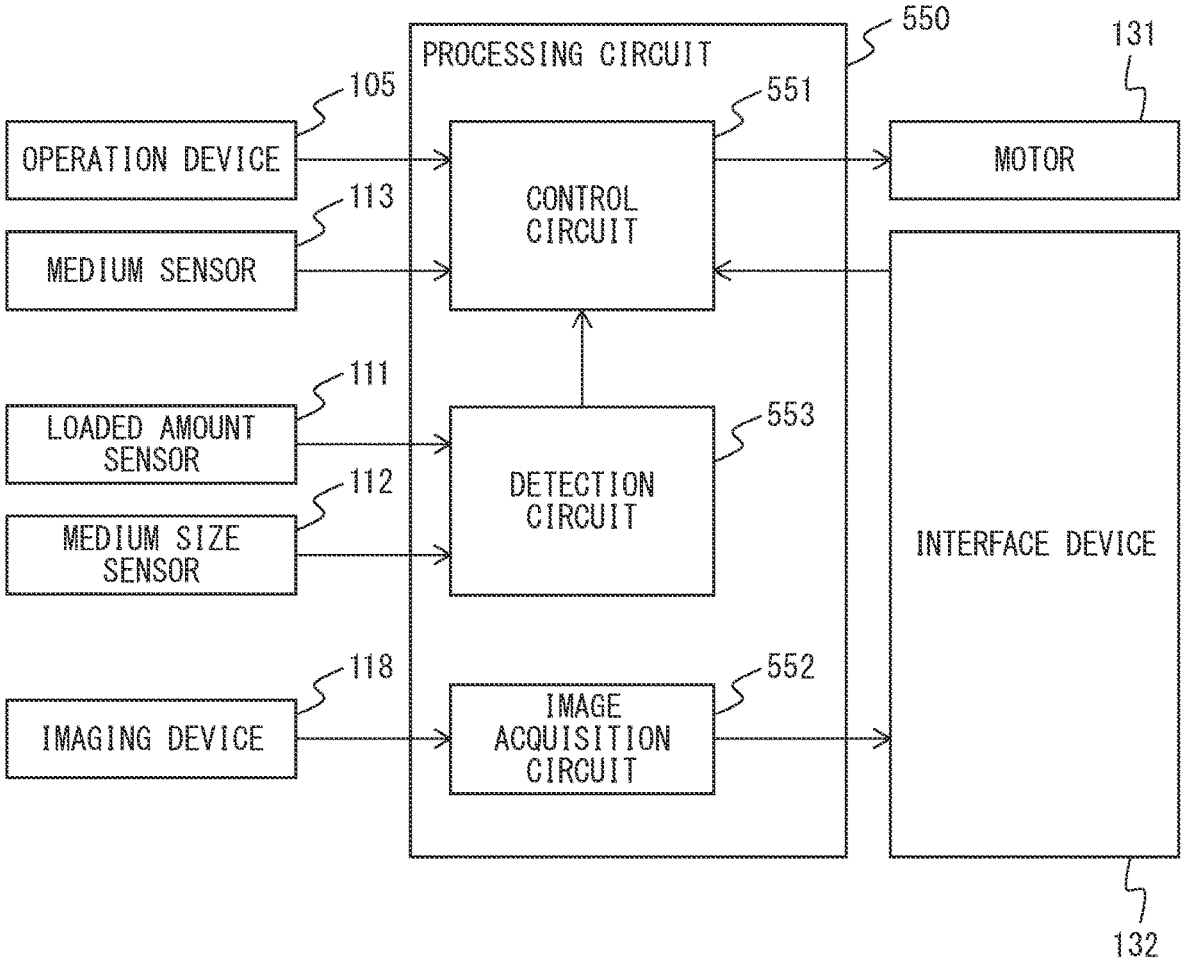
FIG. 22 is a diagram illustrating a schematic configuration of another processing circuit.

FIG. 22 is a diagram illustrating a schematic configuration of a processing circuit in a medium conveying apparatus according to yet another embodiment. The processing circuit 550 is used in place of the processing circuit 150 in the medium conveying apparatus 100 and executes the medium reading process, etc., in place of the processing circuit 150. The processing circuit 550 includes a control circuit 551, an image acquisition circuit 552, a detection circuit 553, etc. Each component may be independently configured with an integrated circuit, a microprocessor, firmware, etc.

The control circuit 551 is an example of a control module and has a function similar to that of the control module 151. The control circuit 551 receives an operation signal from an operation device 105 or an interface device 132, a medium signal from a medium sensor 113, and a detection result of a loaded amount and the size of media from the detection circuit 553. The control circuit 551 controls a motor 131, based on the received information.

The image acquisition circuit 552 is an example of an image acquisition module and has a function similar to that of the image acquisition module 152. The image acquisition circuit 552 acquires an input image from an imaging device 118 and outputs the image to the interface device 132.

The detection circuit 553 is an example of a detection module and has a function similar to that of the detection module 153. The detection circuit 553 receives a loaded amount signal from a loaded amount sensor 111 and a medium size signal from a medium size sensor 112. The detection circuit 553 detects a loaded amount and the size of media, based on the received signals and outputs the detection result to the control circuit 551.

As described in detail above, the medium conveying apparatus can satisfactorily feed a medium when the processing circuit 550 is used as well.

REFERENCE SIGNS LIST

100 MEDIUM CONVEYING APPARATUS, 103 Loading tray, 114 Feed roller, 115 Separation roller, 123 Separation roller cover, 123*a* Guide surface, 124 Bottom surface guide, 125 First guide, 126, 226, 326, 426 Second guide, 151 Control module, 153 Detection module, 226*a* Fixed part, 226*b* Moving part

The invention claimed is:

1. A medium conveying apparatus comprising:

a loading tray;

a feed roller to feed a medium placed on the loading tray;

a separation roller located above the feed roller to face the feed roller;

a bottom surface guide located at a first position where contact between a bottom surface of the medium placed on the loading tray and the feed roller is restricted, before medium feeding, and located at a second position where contact between the bottom surface of the medium placed on the loading tray and the feed roller is allowed, at a time of medium feeding;

a first guide engaged with the bottom surface guide located at the first position to restrict contact between a front edge of the medium placed on the loading tray and the separation roller, before medium feeding; and a second guide including a contact surface coming into contact with the front edge of the medium at a position apart upwardly by a predetermined distance from a nip part of the feed roller and the separation roller, at a time of medium feeding, wherein the contact surface is located inside an outer peripheral surface of the separation roller such that the contact surface does not protrude outside the outer peripheral surface when viewed from a sheet medium width direction which is perpendicular to a medium conveying direction before the medium feeding.

2. The medium conveying apparatus according to claim 1, wherein the second guide is located in such a way as not to overlap the feed roller viewed from the sheet medium width direction.

3. The medium conveying apparatus according to claim 1, wherein the first guide is engaged with the bottom surface guide located at the first position in such a way as to be tilted relative to the bottom surface guide, and wherein an angle formed by the first guide and the bottom surface is greater than 45° and less than 90°.

4. The medium conveying apparatus according to claim 1, wherein a plurality of the first guides are spaced at intervals of a width of a minimum medium size supported by the medium conveying apparatus or less in the sheet medium width direction.

5. The medium conveying apparatus according to claim 1, wherein the contact surface is located in central part of the medium in the sheet medium width direction.

6. The medium conveying apparatus according to claim 1, wherein the contact surface is tilted relative to a nip surface of the feed roller and the separation roller.

7. The medium conveying apparatus according to claim 1, wherein the second guide includes:

a fixed part provided above by the predetermined distance from the nip part; and a moving part provided between the fixed part and the nip part to be movable by a front edge of a fed medium.

8. The medium conveying apparatus according to claim 1, wherein the second guide is provided to be movable by a medium coming into contact with the separation roller when a height of the medium is greater than or equal to a predetermined height.

9. The medium conveying apparatus according to claim 1, further comprising:

a sensor to detect a loaded amount or a size of the medium placed on the loading tray; and a processor to move the second guide according to the loaded amount or the size.

10. The medium conveying apparatus according to claim 1, wherein the medium conveying apparatus has a separation mode for separating and feeding a medium and a non-separation mode for feeding a medium without separation, and the medium conveying apparatus further comprises a processor to retract the second guide when the medium conveying apparatus operates in the non-separation mode.

11. The medium conveying apparatus according to claim 1, wherein a friction coefficient of a region above a predetermined position of the contact surface coming into contact with a front edge of a medium is greater than a friction coefficient of a region below the predetermined position.

* * * * *